US007390077B2

(12) United States Patent
Miyazaki et al.

(10) Patent No.: US 7,390,077 B2
(45) Date of Patent: Jun. 24, 2008

(54) CARRIAGE AND RECORDING APPARATUS INCORPORATING THE SAME

(75) Inventors: Kenichi Miyazaki, Nagano (JP); Atsushi Sumii, Nagano (JP); Hideyuki Takeuchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 298 days.

(21) Appl. No.: 11/007,171

(22) Filed: Dec. 9, 2004

(65) Prior Publication Data

US 2005/0243124 A1 Nov. 3, 2005

(30) Foreign Application Priority Data

| | | |
|---|---|---|
| Dec. 9, 2003 | (JP) | 2003-411041 |
| Dec. 9, 2003 | (JP) | 2003-411042 |
| Dec. 9, 2003 | (JP) | 2003-411043 |
| Dec. 9, 2003 | (JP) | 2003-411050 |
| Dec. 6, 2004 | (JP) | 2004-353311 |

(51) Int. Cl.
*B41J 23/00* (2006.01)
*B41J 25/34* (2006.01)

(52) U.S. Cl. ..... 347/37; 400/283

(58) Field of Classification Search ..... 347/8, 347/37

See application file for complete search history.

(56) References Cited

U.S. PATENT DOCUMENTS

| | | | | |
|---|---|---|---|---|
| 4,547,089 | A | 10/1985 | Jung et al. | |
| 2004/0061739 | A1 * | 4/2004 | Lewis et al. | 347/37 |

FOREIGN PATENT DOCUMENTS

| | | | |
|---|---|---|---|
| EP | 0 696 511 | A2 | 2/1996 |
| JP | 62-124972 | A | 6/1987 |
| JP | 4-142966 | A | 5/1992 |
| JP | 9-202016 | A | 8/1997 |
| JP | 11-124271 | A | 5/1999 |
| JP | 2002-67428 | A | 3/2002 |
| JP | 2002-264419 | A | 9/2002 |

OTHER PUBLICATIONS

International Search Report for PCT/JP2004/018391, Jan. 4, 2005, Japanese Patent Office.*
European Search Report.

* cited by examiner

*Primary Examiner*—Matthew Luu
*Assistant Examiner*—Lisa M Solomon
(74) *Attorney, Agent, or Firm*—Sughrue Mion, PLLC

(57) ABSTRACT

A first shaft member extends in a first direction. A second shaft member extends in the first direction. A carriage body is disposed between the first shaft member and the second shaft member. A first slider comes in contact with a circumferential part of the first shaft member to allow the carriage body to slide on the first shaft member in the first direction. A second slider comes in contact with a circumferential part of the second shaft member to allow the carriage body to slide on the second shaft member in the first direction.

11 Claims, 33 Drawing Sheets

FIG. 26

| CONDITION | SHEET TYPE | SHEET STATE | FOLLOWER ROLLER | SUPPORT RIB |
|---|---|---|---|---|
| 1 | CUT SHEET | NORMAL | SPUR ROLLER | PRESENT |
| 2 | CUT SHEET | DELICATE | LOG ROLLER | PRESENT |
| 3 | ROLLED SHEET | NORMAL | RELEASED | ABSENT |
| 4 | ROLLED SHEET | THIN | SPUR ROLLER (EJECTION ONLY) | ABSENT |
| 5 | ROLLED SHEET | HYGROSCOPIC | SPUR ROLLER (PRINTING AND EJECTION) | ABSENT |
| 6 | ROLLED SHEET | CUT SHORTLY | SPUR ROLLER ( EJECTION ONLY) | ABSENT |
| 7 | HAND-FED SHEET | THICK | RELEASED | ABSENT |

CARRIAGE AND RECORDING APPARATUS INCORPORATING THE SAME

BACKGROUND OF THE INVENTION

The present invention relates to carriage for mounting a recording head, and a recording apparatus or a liquid ejecting apparatus having a mechanism for adjusting the distance between the recording head and a recording medium opposed thereto.

Among large-size recording apparatus capable of recording on up to a sheet (recording medium) of a relatively large size such as the A4 to A2 size of the JIS (Japanese Industrial Standards) standard are ink jet printers. In such large-size ink jet printers, a sheet is supplied from and ejected to the front side for the following reason: unlike in small-size ink jet printers, it is difficult to supply a sheet from the back side and eject it to the front side because relatively heavy sheets need to be handled.

An ink jet printer is known in which a sheet supply tray and a sheet ejection tray are disposed on the front side. A sheet that is accommodated in the sheet supply tray is taken out by a sheet supplying roller and then fed to a platen of a recording section by transporting the sheet by a sheet feeding roller and a follower roller while holding it therebetween. Recording is performed on the sheet by ejecting ink droplets from a recording head, and the sheet is then ejected to the ejection tray by transporting it by a sheet ejecting roller and a spur roller serving as a follower roller while holding it therebetween (cf., Japanese Patent Publication No. 11-124271A).

Such an ink jet printer is equipped with a gap adjusting mechanism capable of adjusting the gap between the recording head and the sheet so that it is always kept constant even if the medium thickness is varied (cf., Japanese Patent Publication No. 2002-67428A).

In the above ink jet printer, the carriage is attached to a guide shaft extending in the primary scanning direction via thrust bearings that are attached to the carriage on the back side. A front portion of the carriage is mounted on a frame of the printer and the carriage is slid along the guide shaft and the frame by a belt mechanism. However, if the ink jet printer is of a large size, the carriage is also large and heavy and hence the resistance of sliding on the guide shaft and the frame is high, which may result in wear of the guide shaft and the frame or a bend of the guide shaft. Wear or a bend of the guide shaft or the frame lowers the accuracy of reciprocation of the carriage, which may in turn lower the recording accuracy.

In the above ink jet printer, the gap is adjusted by rotating two eccentric shafts that guide the carriage on the front side and the back side as the carriage is moved. However, since the drive force of a motor for rotating the eccentric shafts is transmitted by a gear mechanism, backlash tends to occur to possibly lower the accuracy of the gap adjustment.

SUMMARY OF THE INVENTION

It is therefore an object of the present invention to provide a carriage capable of maintaining its highly accurate reciprocative movement and a recording apparatus and a liquid ejecting apparatus incorporating such a carriage.

It is also an object of the invention to provide a mechanism capable of performing a highly accurate gap adjustment and a recording apparatus and a liquid ejecting apparatus incorporating such a gap adjusting mechanism.

In order to achieve the above objects, according to the invention, there is provided a carriage mechanism, comprising:

a first shaft member, extending in a first direction;

a second shaft member, extending in the first direction;

a carriage body, disposed between the first shaft member and the second shaft member;

a first slider, coming in contact with a circumferential part of the first shaft member to allow the carriage body to slide on the first shaft member in the first direction; and a second slider, coming in contact with a circumferential part of the second shaft member to allow the carriage body to slide on the second shaft member in the first direction.

With this configuration, since the respective sliders are not entirely in contact with the circumferential parts of the respective shaft members, the sliders can be slid smoothly without enhancing the straightness or parallelism of the shaft members.

Preferably, the first slider comprises a first plate member coming in contact with the circumferential part of the first shaft member, and the second slider comprises a second plate member coming in contact with the circumferential part of the second shaft member.

With this configuration, since the carriage body is not directly in contact with the shaft members, frictional wear of the shaft members due to the slide movement of the carriage body can be avoided. In addition, the respective plate members can be made with wear-proof material. Thus, frictional wear of the plate members due to the slide movement of the carriage body can be avoided, so that high accuracy of the reciprocal movement of the carriage can be maintained.

Here, it is preferable that the second slider comprises an urging member which urges the second plate member against the second shaft member.

With this configuration, the first plate member can be pressed against the first shaft member through the carriage body. In a case where the carriage is reciprocated along the first shaft member serving as a main shaft member, high accuracy of the reciprocal movement of the carriage can be maintained.

It is also preferable that: the first plate member has a C-shaped cross section viewed from the first direction, so that both ends of the C-shaped cross section come in contact with the first shaft member while forming a clearance between the first shaft member and a center part of the C-shaped cross section; and the second plate member has a C-shaped cross section viewed from the first direction, so that both ends of the C-shaped cross section come in contact with the second shaft member while forming a clearance between the second shaft member and a center part of the C-shaped cross section.

With this configuration, the respective plate members can be flexed by such an amount corresponding to the clearances, so that the positioning error or the working error can be absorbed. Accordingly, high accuracy of the reciprocal movement of the carriage can be maintained.

It is also preferable that the first slider comprises a first rolling member coming in contact with the first plate member, and the second slider comprises a second rolling member coming in contact with the second plate member.

With this configuration, the frictional resistance between the carriage body and the respective plate members can be considerably reduced in order to suppress frictional wear of the respective plate members. Accordingly, high accuracy of the reciprocal movement of the carriage can be maintained.

Preferably, the carriage mechanism further comprises:

a recording head, carried by the carriage body; and an endless belt member suspended by the first shaft member and the second shaft member, wherein the first shaft member is rotatable about an eccentric axis, and the second shaft member is interlockingly rotated by the endless belt member in accordance with the rotation of the first shaft member, thereby varying a distance between the recording head and a recording target.

With this configuration, backlash liable to be occurred in the gear mechanism can be prevented, so that the gap adjustment can be performed with high accuracy.

Here, it is preferable that the endless belt member is tensed. With this configuration, phase shift of synchronous rotation between the both shaft members can be prevented, so that the gap adjustment can be performed with high accuracy.

In order to achieve the above objects, it is preferable that the recording head is a liquid ejection head from which liquid droplets are ejected toward the recording target.

With this configuration, it is possible to provide a liquid ejection head which attains the above advantages.

According to the invention, there is also provided a carriage mechanism, comprising:

a carriage body;

a first shaft member, extending in a first direction;

a slider, coming in contact with a first circumferential part of the first shaft member to allow the carriage body to slide on the first shaft member in the first direction; and a support member, which supports the first shaft member, the support member being provided on a second circumferential part of the first shaft member at a longitudinal center portion of the first shaft member.

With this configuration, the flexure of the main guide shaft can be suppressed even when the carriage has large size and weight. Accordingly, high accuracy of the reciprocal movement of the carriage can be maintained.

Preferably, the first shaft member is rotatable about an eccentric axis, and the support member comprises:

an adjuster, fitted with the second circumferential part of the first shaft member, and having an outer peripheral face which is configured such that a distance from the eccentric axis is made constant at anywhere in the outer peripheral face; and a retainer, which presses the outer peripheral face of the adjuster against the first shaft member.

With this configuration, the adjuster and the retainer can be always kept contacting the first shaft member even when the first shaft member is eccentrically rotated to perform adjustment for the carriage.

Preferably, the carriage mechanism further comprises a second shaft member extending in the first direction. The carriage body is disposed between the first shaft member and the second shaft member. The second circumferential part is opposite to a circumferential part of the first shaft member which opposes to the second shaft member.

With this configuration, even if an urging member is provided in the side of the second shaft member to urge the carriage body toward the first shaft member, the reaction force of the urging member can be absorbed by the first shaft member side. Accordingly, high accuracy of the reciprocal movement of the carriage can be maintained.

Preferably, the carriage body carries a recording head which performs recording operation with respect to a recording medium being transported in a second direction perpendicular to the first direction.

In order to achieve the above objects, it is preferable that the recording head is a liquid ejection head from which liquid droplets are ejected toward the recording target.

With this configuration, it is possible to provide a liquid ejection head which attains the above advantages.

BRIEF DESCRIPTION OF THE DRAWINGS

FIG. 26 is a table showing the state switchings of the follower roller unit and the supporting rib unit;

DESCRIPTION OF THE INVENTION

Embodiments of the present invention will be hereinafter described in detail with reference to the accompanying drawings.

Figure 1:
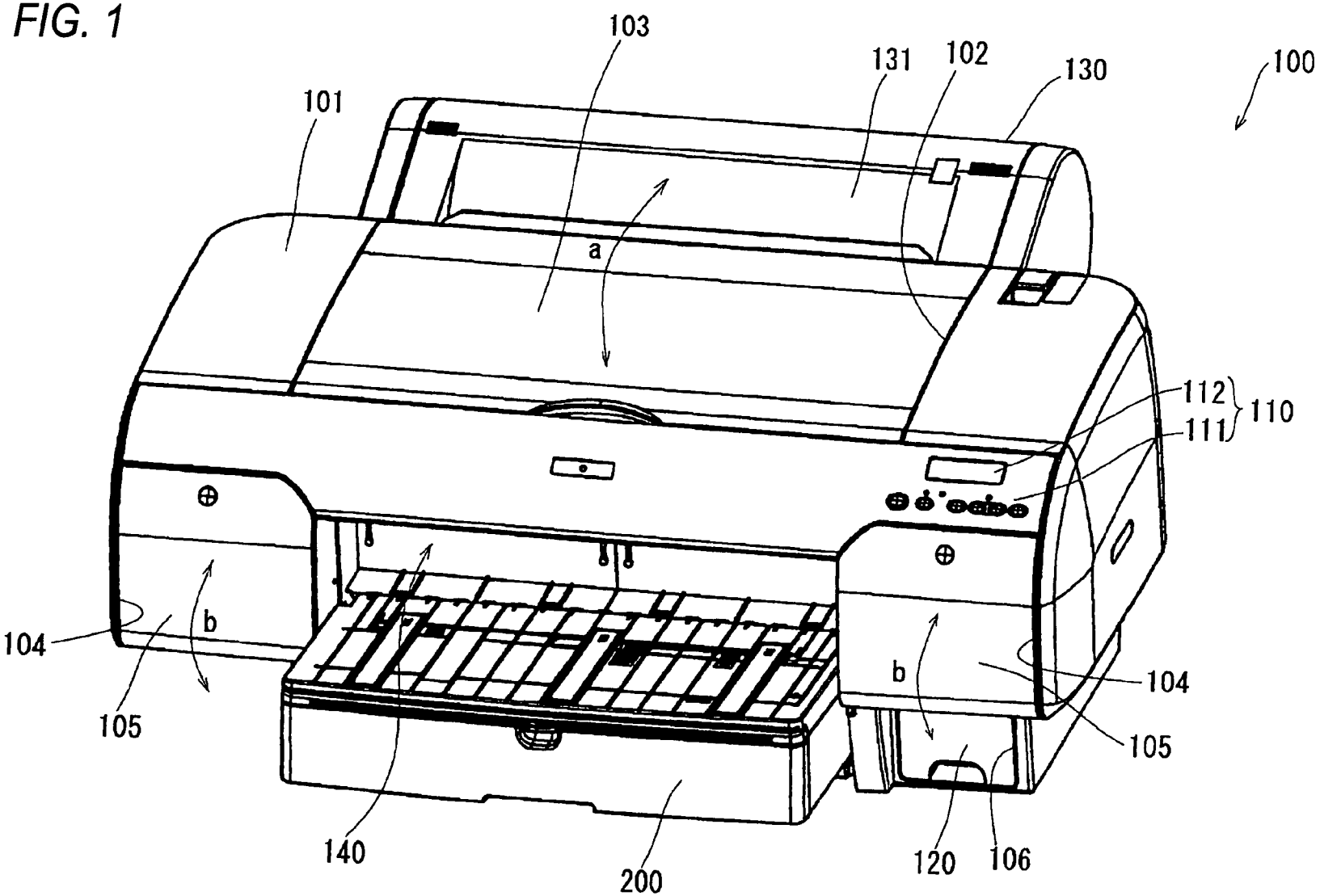
FIG. 1 is a perspective view of an ink jet printer according to one embodiment of the invention.

As shown in FIG. 1, an ink jet printer (recording apparatus) 100 according to one embodiment of the invention is a large-size, desk-top printer capable of recording on what is called a cut sheet of a relatively large size such as the A4 to A2 size of the JIS standard and an equivalent rolled sheet. The inside of the ink jet printer 100 is entirely covered with a housing 101 that generally assumes a rectangular parallelepiped shape that is long in the width direction.

The top face of the housing 101 is formed with a rectangular window 102, which is covered with a transparent or semi-transparent window cover 103. The window cover 103 is attached so as to be pivotable in directions indicated by arrows "a" in FIG. 1 about a pivot axis that is located on the rear side. A user can perform maintenance work or the like on the internal mechanisms through the window 102 by lifting up the window cover 103 and thereby opening the window 102.

Cartridge chambers 104 in which plural ink cartridges are to be detachably inserted are formed at the front-right and front-left positions of the housing 101. Recording inks of several colors are stored in the respective ink cartridges. The cartridge chambers 104 are covered with transparent or semi-transparent cartridge covers 105, respectively. Each cartridge cover 105 is attached so as to be pivotable in directions indicated by arrows "b" in FIG. 1 about a pivot axis that is located at the bottom. The user can perform ink cartridge replacement work or the like by opening a cartridge chamber 104 by weakly pushing the cartridge cover 105 and thereby unlocking a locking portion.

A control panel 110 by which to input an instruction of a printer operation is provided in a portion of the housing 101 that is located over the front-right cartridge chamber 104. The control panel 110 is provided with: buttons 111 such as a power button for activating/deactivating the printer, manipulation buttons for manipulations for positioning a leading end of a recording sheet, ink flashing, etc., and processing buttons for image processing etc.; a liquid crystal panel 112 for displaying various statuses; and other members. The user can manipulate the buttons 111 while watching the liquid crystal panel 112 to check displayed information.

A tank chamber 106 in which a waste liquid tank 120 is detachably inserted is formed under the front-right cartridge chamber 104. The waste liquid tank 120 stores waste ink that is discarded at the time of cleaning of a recording head 162 (see FIG. 5) or replacement of an ink cartridge. The user can perform, for example, work of discarding the waste ink stored in the waste ink tank 120 by drawing out the waste ink tank 120.

A sheet supplying section 130 for supplying a part of a rolled sheet is disposed at the rear of the housing 101 so as to project in a top-rear direction. A rolled sheet holder (not shown) in which one rolled sheet can be set is provided inside the sheet supplying section 130, and a flap-type rolled sheet cover 131 that can be opened and closed is attached to the sheet supplying section 130 on the front side so as to cover the rolled sheet holder. The user can perform, for example, work of attaching or detaching a rolled sheet by lifting up the rolled sheet cover 131 and thereby opening the sheet supplying section 130. The top face of the rolled sheet cover 131 is formed into a guide face capable of guiding cut sheets for manual feeding.

A sheet supplying/ejecting section 140 into and from which a tray unit 200 to be loaded with unrecorded cut sheets and recorded cut sheets or a recorded part of a rolled sheet is to be inserted and removed is formed in the housing 101 at the front-center, that is, between the two cartridge chambers 104. The sheet supplying/ejecting section 140 is formed so as to also allow manual feeding of thick sheets that cannot be bent while being transported.

The tray unit 200 is fixed to the sheet supplying/ejecting section 140 in such a manner that the head-side half of the tray unit 200 is inserted in the sheet supplying/ejecting section 140 and the tail-side half is projected therefrom. The tray unit 200 assumes a cassette-like shape; unrecorded cut sheets are stacked and accommodated inside and recorded and ejected cut sheets or parts of rolled sheet are stacked thereon. A detailed structure of the tray unit 200 will be described below with reference to FIGS. 2 to 4.

Figure 2:
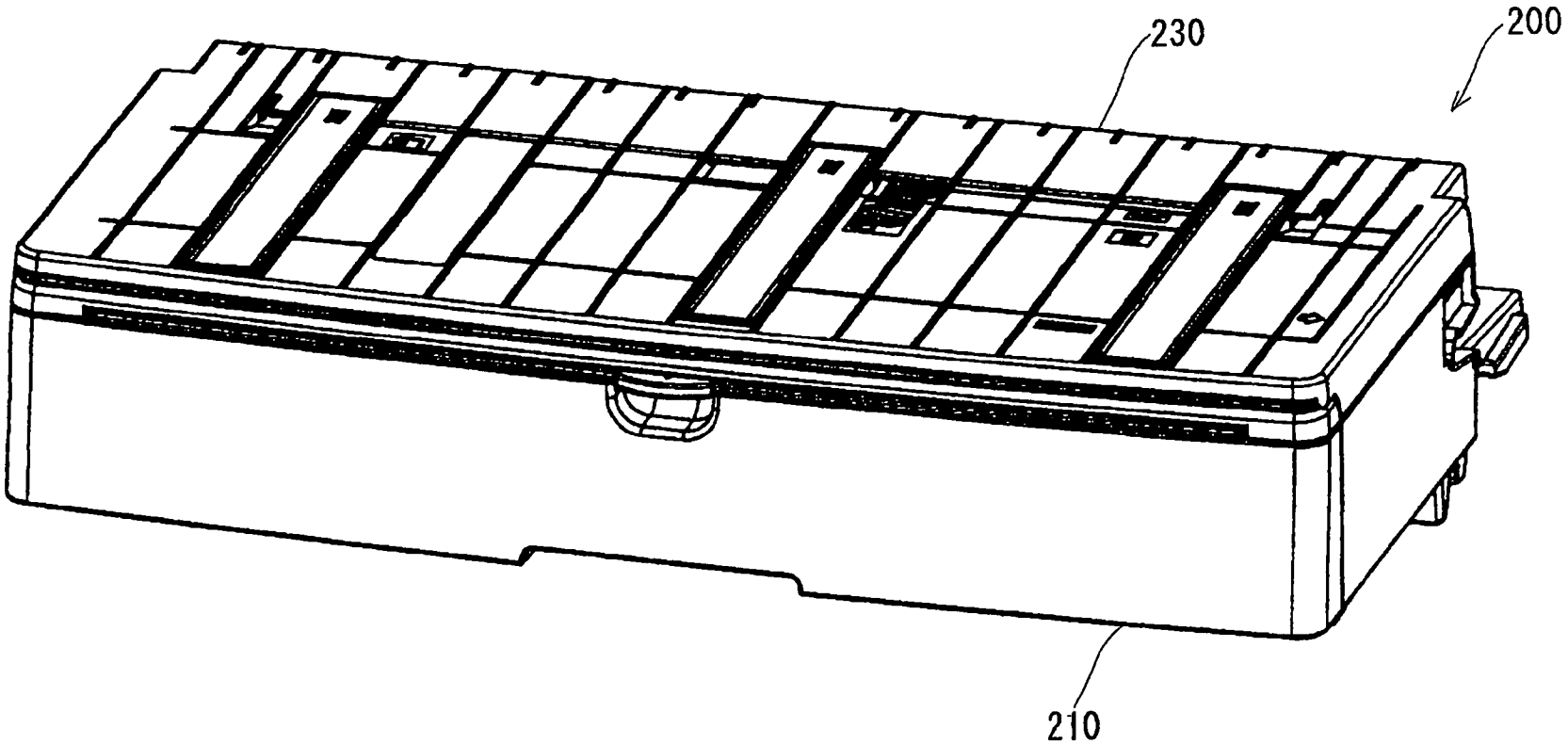
FIG. 2 is a perspective view of a tray unit in the printer of FIG. 1.

As shown in FIG. 2, the tray unit 200 has a box-shaped sheet supply tray 210 and a lid-shaped sheet ejection tray 230 that covers the sheet supply tray 210 from above. Capable of expansion and contraction in the sheet supplying/ejecting direction, the tray unit 200 can be accommodated compactly while not in use and can accommodate cut sheets of various sizes while in use.

Figure 3:
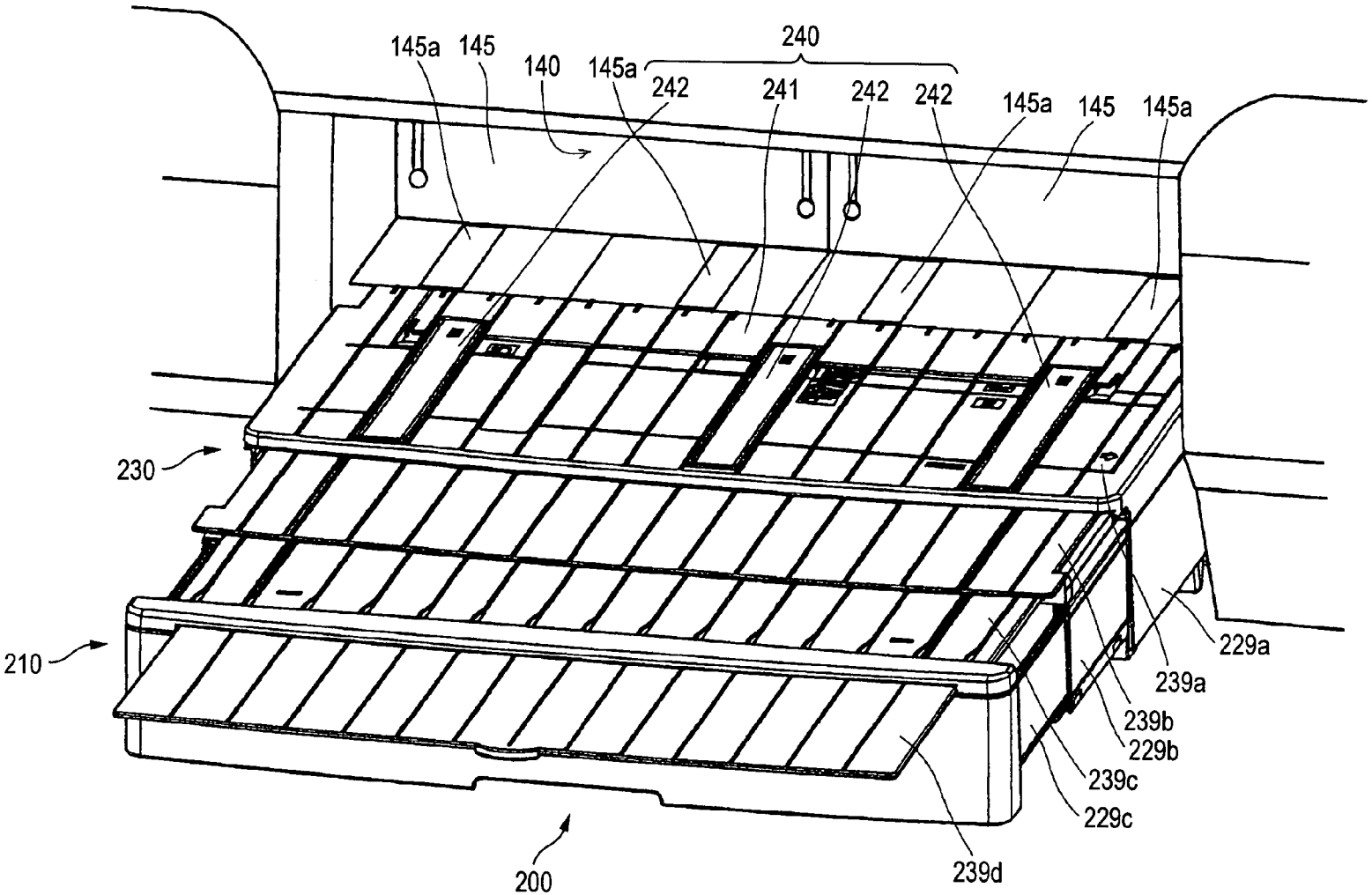
FIG. 3 is a perspective view showing a used state of the tray unit of FIG. 2.

To be mounted with cut sheets in a stacked manner, as shown in FIG. 3, a rolled sheet guiding section 240 is made flush with the top face of a sheet ejection member 239*a* to form a flat plane together with the top face of the sheet ejection member 239*a*. With this measure, cut sheets that are ejected after passing by a sheet ejecting roller 155 (see FIG. 5) are stacked smoothly on an ejected sheet receiving face that is formed by the rear and bottom faces of a guide portion 145 having an L-shaped cross section and the top faces of sheet ejection members 239*a* to 239*d*.

Sponge mats 145*a* are pasted on the bottom face of the guide portion 145. The sponge mats 145*a* have a slip-preventing function of preventing a phenomenon that when a second cut sheet comes in a state that a first cut sheet is already mounted, the head of the second cut sheet pushes the first cut sheet and makes it fall from the ejected sheet receiving face.

Figure 4:
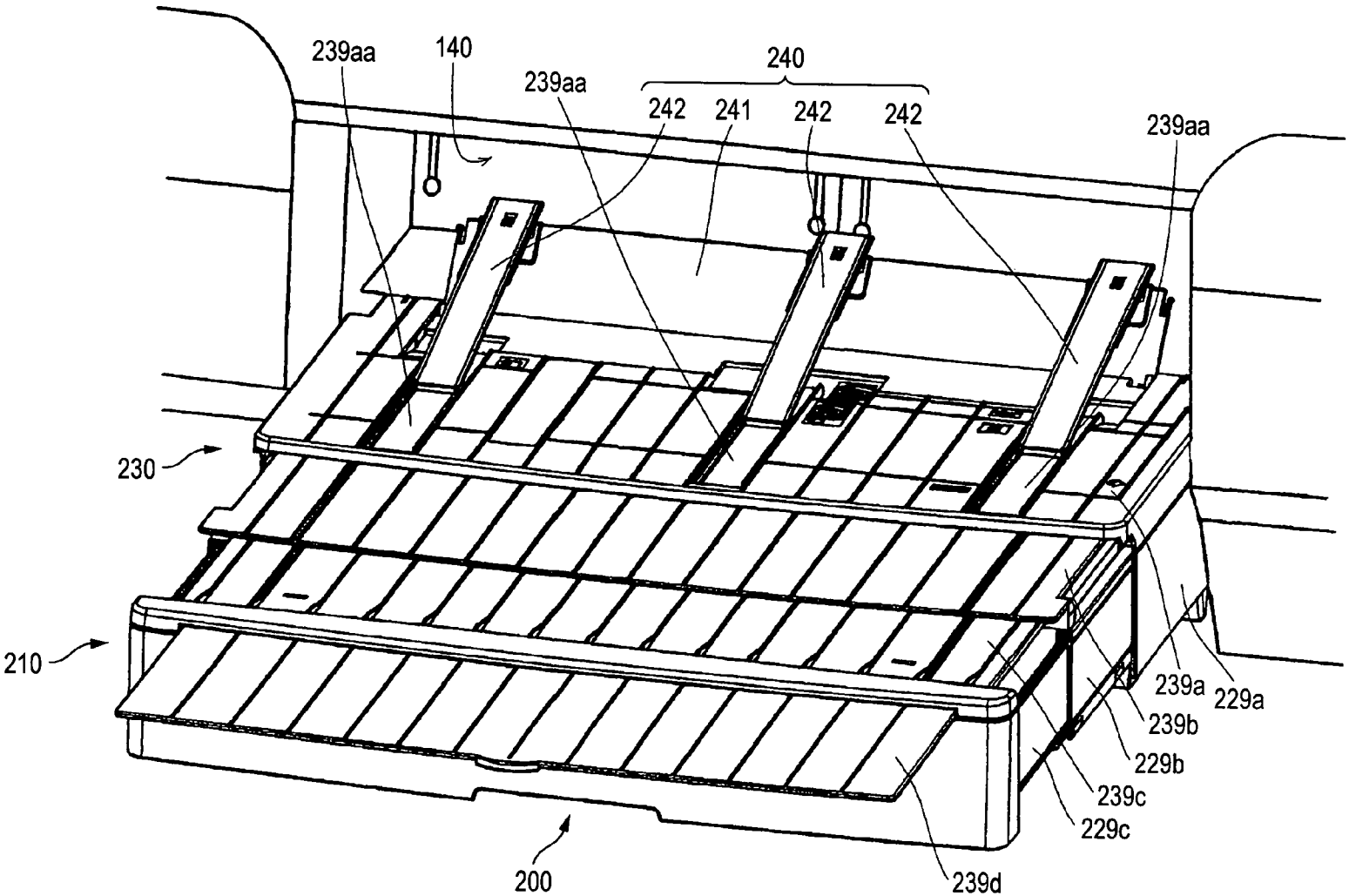
FIG. 4 is a perspective view showing another used state of the tray unit of FIG. 2.

On the other hand, to stack cut parts of rolled sheet, as shown in FIG. 4, the user hooks his finger on a first guide plate 241 of the rolled sheet guiding section 240 that is in the same plane as the top face of the sheet ejection member 239*a* and turns it rearward. As a result, second guide plates 242 are pulled by the first guide plate 241, whereby their one ends in the longitudinal direction are lifted up and the other ends in the longitudinal direction slide rearward along respective grooves 239*aa* that are formed in the top face of the sheet ejection member 239*a*. The user turns the first guide plate 241 until the first guide plate 241 and the second guide plates 242 form an acute angle.

As a result, the one ends in the longitudinal direction of the second guide plates 242 come close to the top of the rear face of the guide portion 145 and the second guide plates 242 come to assume slide-like shapes. By virtue of this structure, even if a cut part of rolled sheet that is ejected after passing by the sheet ejecting roller 155 is curled, its tip portion does not go toward the guide portion 145 but slides on the slide-shaped second guide plates 242 and is guided onto the top faces of the sheet ejection members 239*a* to 239*d*. In this manner, cut parts of the rolled sheet are smoothly stacked on an ejected sheet receiving face that is formed by the top faces of the second guide plates 242 and the sheet ejection members 239*a* to 239*d*.

Figure 5:
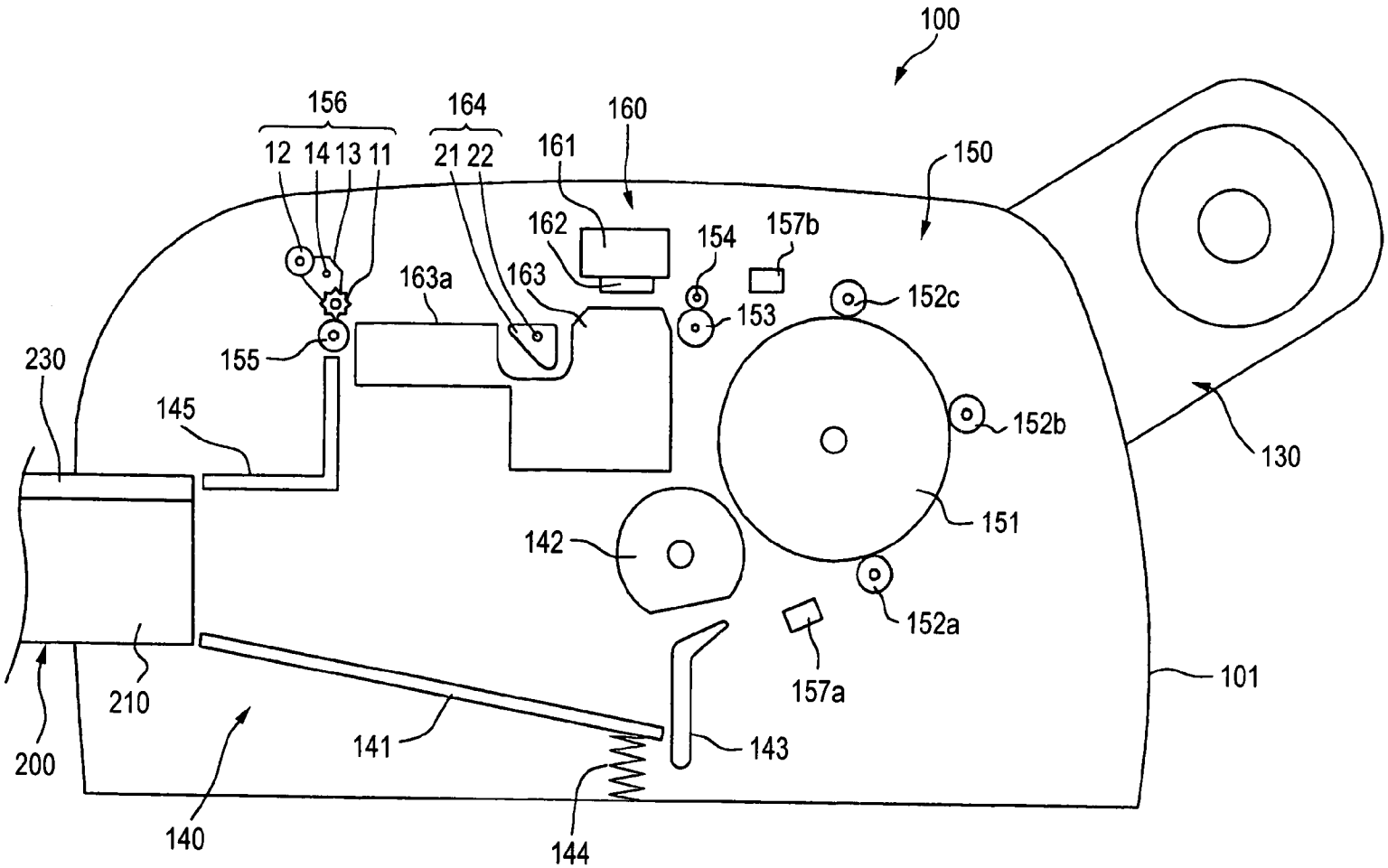
FIG. 5 is a schematic section view showing an internal configuration of the printer of FIG. 1.

As shown in FIG. 5, the sheet supplying/ejecting section 140, a transporting section 150 and a recording section 160 that include important features of the invention, and other components are provided in the housing 101. The sheet supplying/ejecting section 140 is equipped with a hopper 141 for supplying cut sheets, a sheet supplying roller 142, a separator 143, etc. The hopper 141 assumes a flat plate shape capable of being mounted with cut sheets, and is disposed in such a manner that one end is close to the sheet supplying roller 142 and the separator 143 and the other end is close to the bottom face of the sheet supply tray 210 of the inserted tray unit 200. One end of a compression spring 144 is attached to the bottom face of the housing 101 and the other end is attached to the back face of the hopper 141 at its one end. The hopper 141 is rotated about the other end as the compression spring 144 expands or contracts.

The sheet supplying roller 142, which has a D-shaped cross section frictionally transports cut sheets from the hopper 141 by rotating intermittently. The separator 143, which has a rough top face, frictionally separates lower cut sheets from the uppermost one when plural cut sheets are supplied by the sheet supplying roller 142. A relationship between the cut sheets mounted on the hopper 141 and the sheet supplying roller 142 will now be described with reference to FIGS. 6A and 6B.

Figure 6A:
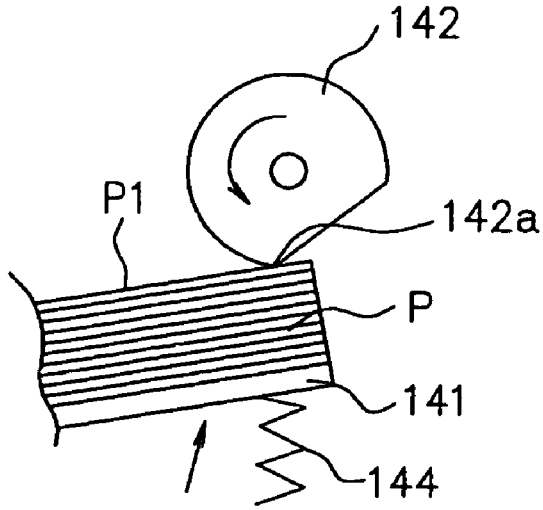
FIGS. 6A and 6B are schematic views showing a contact state between a sheet on a hopper and a sheet feeding roller in the printer of FIG. 1.

FIG. 6A shows a case that a maximum number of cut sheets P are mounted on the hopper 141. Settings are made so that in this case when the hopper 141 is elevated the uppermost cut sheet P1 does not touch the cut portion of the sheet supplying roller 142 but touches an arc start point 142*a* or a point on the circumference that is slightly distant from the arc start point 142*a*.

Figure 6B:
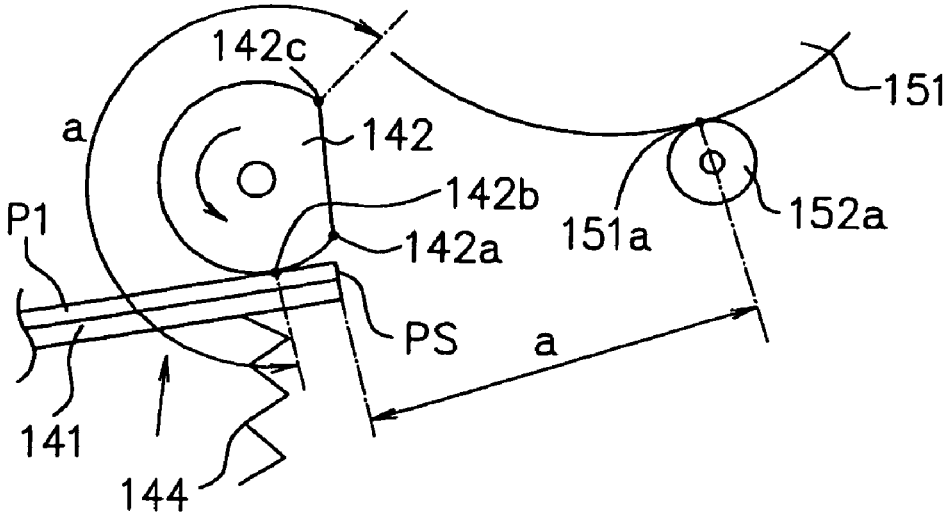

FIG. 6B shows a case that a minimum number (one) of cut sheet P1 is mounted on the hopper 141. The settings are made so that in this case when the hopper 141 is elevated the cut sheet P1 touches a point 142*b* of the sheet supplying roller 142 that is a little distant from the arc start point 142*a*. The contact point 142*b* is such a point that the circumferential length between the contact point 142*b* and an arc end point 142*c* is the same as the interval "a" between the leading end PS of the sheet P1 and a contact point 151 a of a sub roller 151 and its follower roller 152*a*.

With the above settings, if the number of cut sheets P mounted on the hopper 141 is smaller than or equal to the maximum number, the uppermost cut sheet P1 is not released from the sheet supplying roller 142 until the leading end PS of the cut sheet P1 reaches the contact point 151*a* of the sub roller 151 and its follower roller 152*a*. Therefore, the cut sheet P1 can be delivered reliably to the sub roller 151 and erroneous sheet delivery can be avoided.

The transporting section 150 is equipped with the sub roller 151 and its follower rollers 152*a*, 152*b*, and 152*c* for transporting a sheet, a sheet feeding roller 153 and its follower roller 154, a sheet ejecting roller 155 and its follower roller unit 156 that constitute an ejecting section, sensors 157*a* and 157*b* for detecting a sheet, and other components. To eject, to the sheet ejection tray 230, a cut sheet that is supplied from the sheet supply tray 210, the sub roller 151 transports the cut sheet along a U-shaped path (the transport direction is reversed) while holding it together with the follower rollers 152*a*, 152*b*, and 152*c*. To eject, to the sheet ejection tray 230, a part of rolled sheet that is supplied from the sheet supplying section 130, the sub roller 151 transports it while holding it together with the follower roller 152*c*.

The sheet feeding roller 153 sends out, to a platen 163, a cut sheet that has been transported with reversal in direction or a supplied part of rolled sheet while holding it together with the follower roller 154. The sheet ejecting roller 155 ejects, onto the sheet ejection tray 230, a recording sheet that has passed by the platen 163 while supporting it solely or together with the follower roller unit 156. The sensor 157*a* detects a transport length of a supplied cut sheet at the time of skew correction. The sensor 157*b* detects a transport length of a cut sheet that has been transported with reversal in direction or a supplied part of rolled sheet at the time of leading end positioning.

The follower roller unit 156 is equipped with sets of a spur roller 11 and a smooth roller 12 that are brought in contact with or separated from the recording face of a recording sheet being transported on the sheet ejecting roller 155 and a switching shaft 14 for switching the rollers 11 and 12 between a contact state and a separated state. Having saw-toothed projections on the circumferential face, the spur roller 11 serves to transport a recording sheet reliably by cutting into its recording face while holding it together with the sheet ejecting roller 155.

Having a smooth circumferential face, the smooth roller 12 serves to transport a recording sheet reliably by pressing on its recording face while holding it together with the sheet ejecting roller 155. The spur roller 11, the smooth roller 12, and a releaser 13 where neither the spur roller 11 nor the smooth roller 12 is provided are disposed around the switching shaft 14 at prescribed intervals in the circumferential direction, and plural sets of the rollers 11 and 12 and the releaser 13 are arranged in the axial direction at prescribed intervals.

The above-configured follower roller unit 156 can arbitrarily switch between the spur rollers 11 and the smooth rollers 12, between the spur rollers 11 and the releasers 13, and between the smooth rollers 12 and the releasers 13 by rotating the switching shaft 14. The switching between the spur rollers 11 and the releasers 13 or between the smooth rollers 12 and the releasers 13 is equivalent to bringing the spur rollers 11 or smooth rollers 12 into contact with or separating those from the recording face of a recording sheet. Therefore, this switching makes it possible to adapt to many kinds of recording sheets having respective attributes. Although the follower roller unit 156 is equipped with, in each set, the three kinds of single members, that is, the spur roller 11, the smooth roller 12, and the releaser 13, the invention is not limited to such a case. One or more kinds of members may be combined arbitrarily, the number of members of each kind being two or more.

Figure 13:
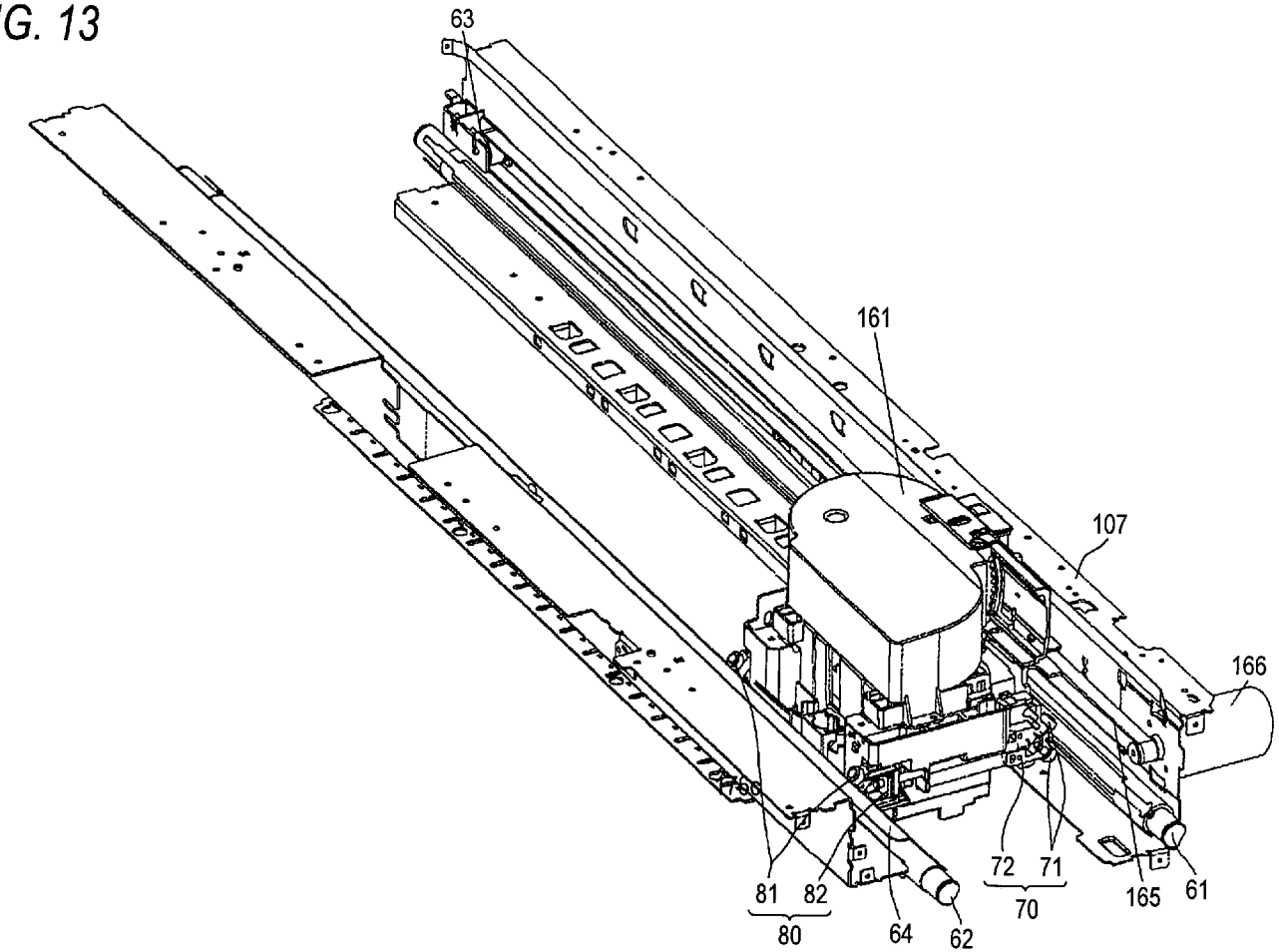
FIG. 13 is a perspective view showing the periphery of a carriage in the printer of FIG. 1 or 7.

The recording section 160 is equipped with a carriage 161, a recording head 162, the platen 163, a support rib unit 164, etc. As shown in FIG. 13, the carriage 161 is connected to a carriage belt 165. As the carriage belt 165 is driven by a carriage motor 166, the carriage 161 is moved together with the carriage belt 165 and is thereby reciprocated above a recording sheet perpendicularly to the sheet transport direction being guided by a main guide shaft 61 and an auxiliary guide shaft 62. The carriage 161 is mounted with the recording head 162 capable of ejecting ink droplets toward an underlying recording sheet.

For example, the recording head 162 is equipped with plural black ink recording heads for ejecting two kinds of black ink and plural color ink recording heads for ejecting ink droplets of six colors of yellow, dark yellow, cyan, light cyan, magenta, and light magenta, respectively. The recording head 162 is provided with pressure generating chambers and nozzle orifices that communicate with the respective pressure generating chambers. Ink is stored in each of the pressure generating chambers and pressurized at a prescribed pressure, whereby ink droplets having a controlled size are ejected toward the recording sheet on the platen 163. A guide face 163*a* as the top face of the platen 163 supports and guides, by itself or together with the support rib unit 164, a recording sheet being transported from the sheet feeding roller 153 and the follower roller 154 to the sheet ejecting roller 155 and the follower roller unit 156.

Figure 18:
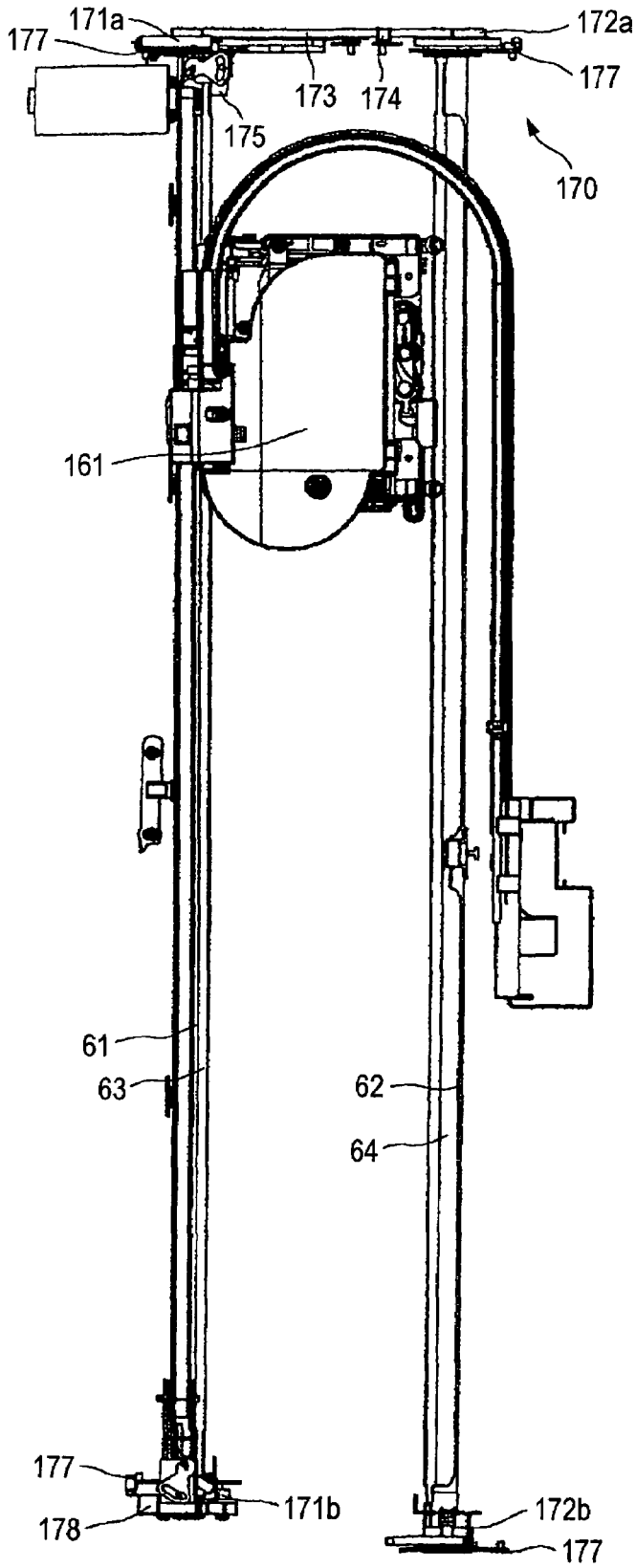
FIG. 18 is a plan view showing a platen gap adjusting mechanism and its periphery in the printer of FIG. 1 or 7.

To enable recording on many kinds of recording sheets having respective attributes (i.e., different thicknesses), a platen gap adjusting mechanism 170 for adjusting the gap between the nozzle formation face of the recording head 162 that is mounted on the carriage 161 and the recording face of a recording sheet being transported on the guide face 163*a* of the platen 163 is provided (see FIG. 18). The main guide shaft 61 and the auxiliary guide shaft 62 are rotatable about respective eccentric rotation axes. The platen gap adjusting mechanism 170 adjusts the gap so that it is always kept constant by rotating the main guide shaft 61 and the auxiliary guide shaft 62 synchronously.

Figure 22:
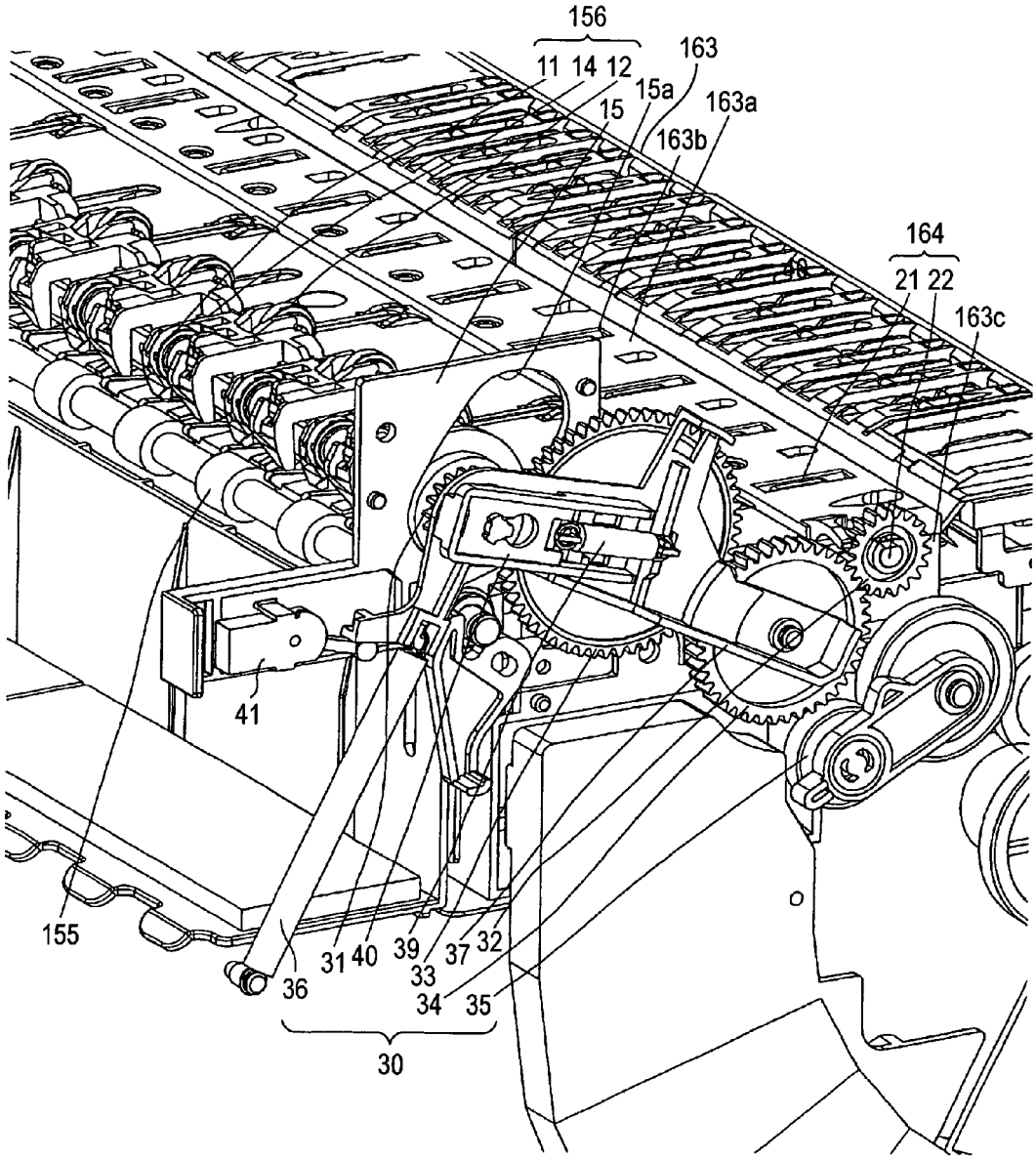
FIGS. 22 and 23 are perspective views showing detailed configuration of a follower roller unit and a supporting rib unit in the printer of FIG. 1 or 7.

As shown in FIG. 22, the support rib unit 164 is equipped with support ribs (projections) 21 that protrude or retract from slits 163*b* that are formed in the guide face 163*a* of the platen 163 and a switching shaft 22 for switching the support ribs 21 between protrusion and retraction. Each support rib 21 is a generally triangular plate member, and one rounded apex portion protrudes from the guide face 163*a* and supports a recording sheet. The two ends of the switching shaft 22 are pivotally supported by side faces 163*c* of the platen 163. Plural support ribs 21 are fixed to the switching shaft 22 so as to be arranged in the axial direction at prescribed intervals.

The above-configured support rib unit 164 makes it possible to arbitrarily switch between the one apex portion and the flat portion of each support rib 21 in the slit 163*b* that is formed in the guide face 163*a* of the platen 163 by rotating the switching shaft 22. That is, the support rib 21 can be protruded by positioning the one apex portion of the support rib 21 with respect to the slit 163*b* that is formed in the guide face 163*a* of the platen 163, and the support rib 21 can be retracted by positioning the flat portion of the support rib 21 with respect to the slit 163*b*. Therefore, the above switching makes it possible to adapt to many kinds of recording sheets having respective attributes (described later in detail).

Figure 7:
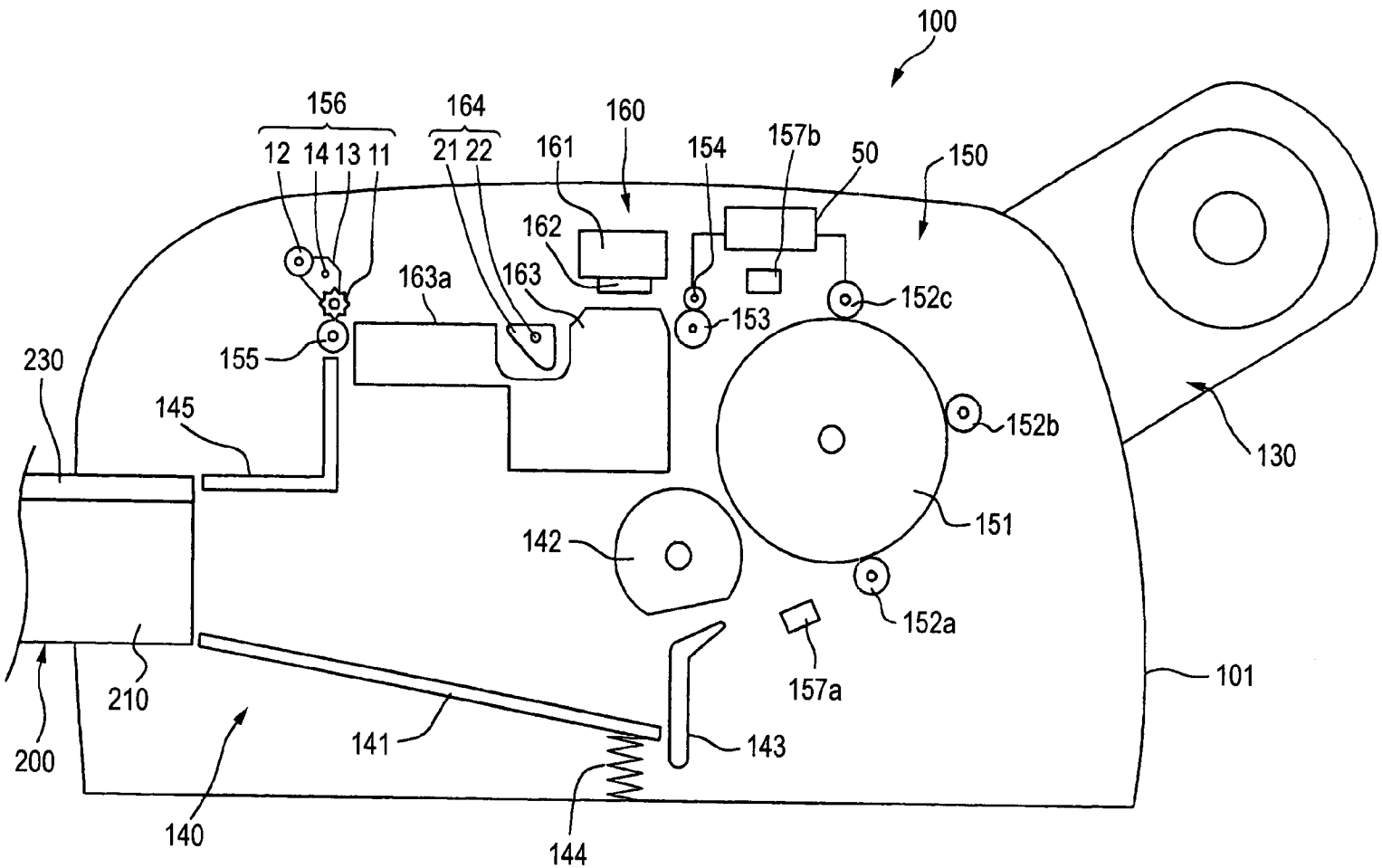
FIG. 7 is a schematic section view showing a modified example of the internal configuration of the printer of FIG. 1.

As shown in FIG. 7, a follower roller driving device 50 for controlling the operation of bringing the follower rollers 152*a*, 152*b*, and 152*c* into contact with or separating those from the sub roller 151 and the operation of bringing the follower roller 154 into contact with or separating it from the sheet feeding roller 153 may be provided. This makes it possible to lower the power consumption of the ink jet printer 100 and to thereby reduce its size.

Figure 8:
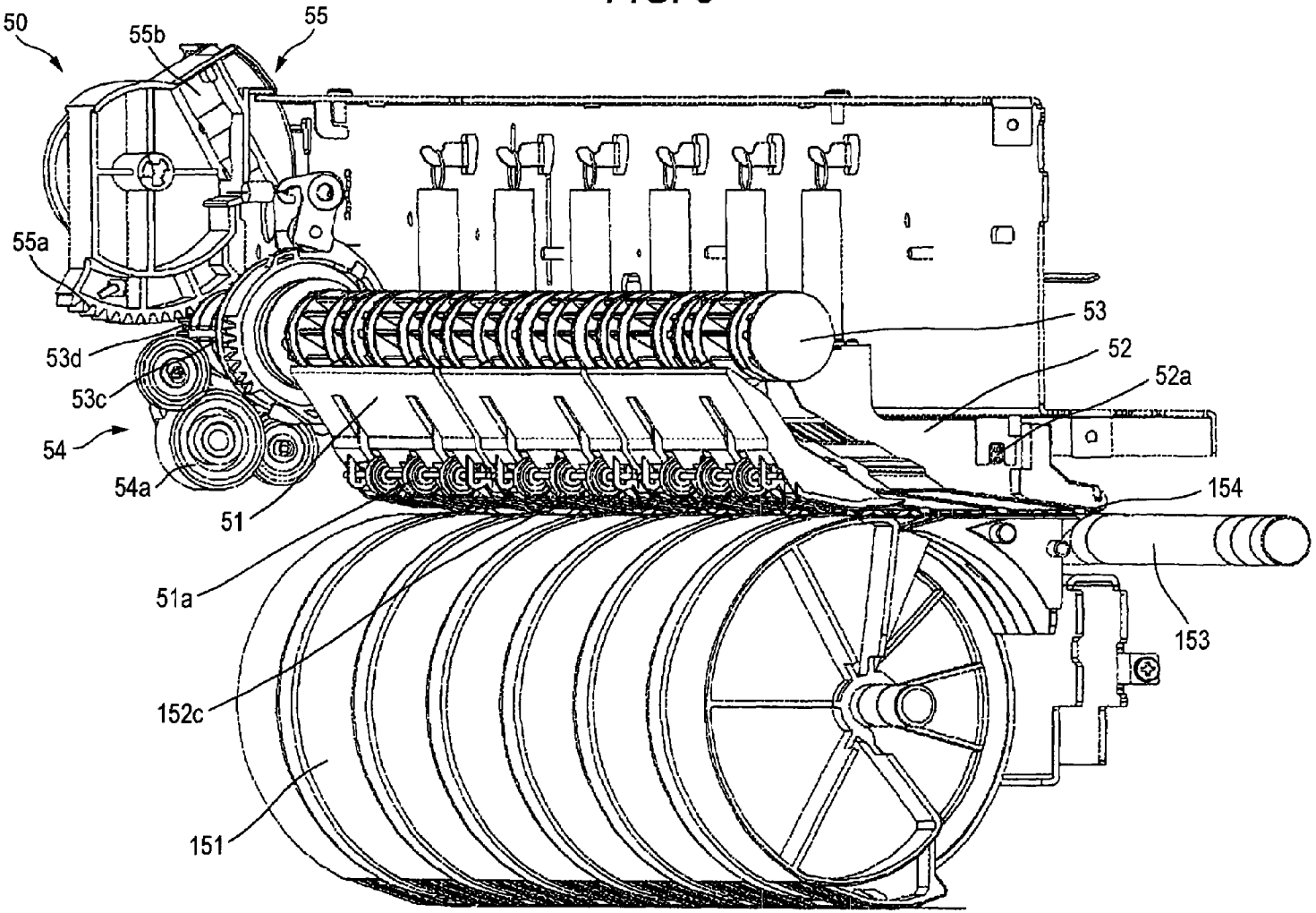
FIG. 8 is a perspective view showing a follower roller driving device and its periphery in the printer of FIG. 7.

As shown in FIG. 8, the follower roller driving device 50 is equipped with pivot members 51 and 52, a cam shaft 53, and gear units 54 and 55. The follower roller 152*c* is rotatably attached to one end of the pivot member 51 and the other end of the pivot member 51 is to contact the cam shaft 53. And the follower roller 152*c* swings about a central shaft 51*a*. The follower roller 154 is rotatably attached to one end of the pivot member 52 and the other end of the pivot member 52 is to contact the cam shaft 53. And the follower roller 154 pivots about a central shaft 52*a*.

The cam shaft 53 is separately provided with a cam 53*a* (see FIG. 9) that acts on the pivot member 51 and a cam 53*b* (see FIG. 11) that acts on the pivot member 52. An intermittent gear 53*c* to mesh with the gear unit 54 and an intermittent gear 53*d* to mesh with the gear unit 55 are fit in the cam shaft 53 at one end. The gear unit 54 is provided with a planetary gear 54*a* for intermittently transmitting drive force of a motor (not shown) to the intermittent gear 53*c* of the cam shaft 53. The gear unit 55 is provided with a lever 55*b* that is rotatable and can be operated manually and that is formed with a gear 55*a* to mesh with the intermittent gear 53*d* of the cam shaft 53. How the above-configured follower roller driving device 50 operates will be described below with reference to the drawings.

Figure 9:
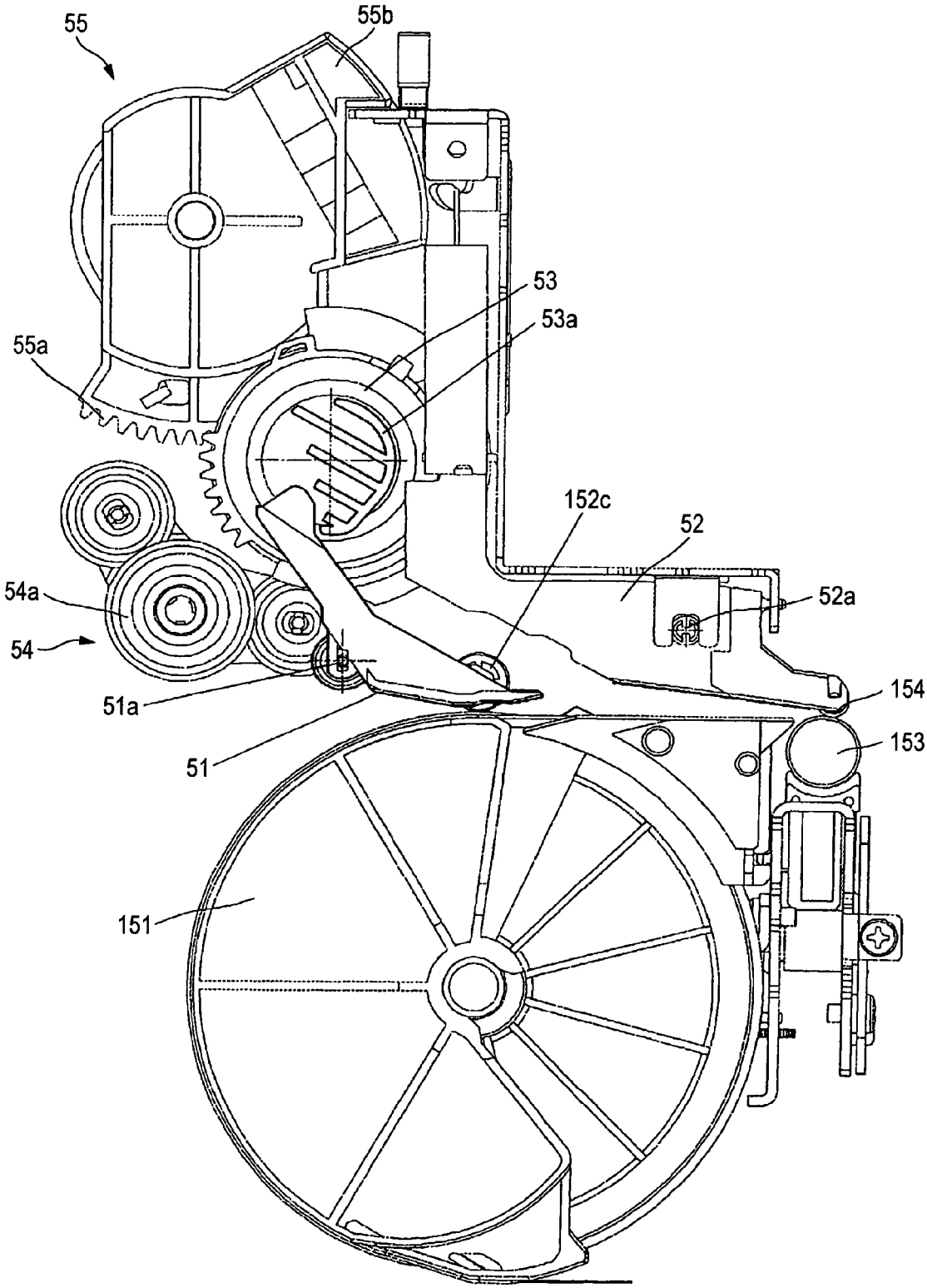
FIGS. 9 and 10 are section views showing a case where only a follower roller of a sub roller in the printer of FIG. 7 is operated.
Figure 10:
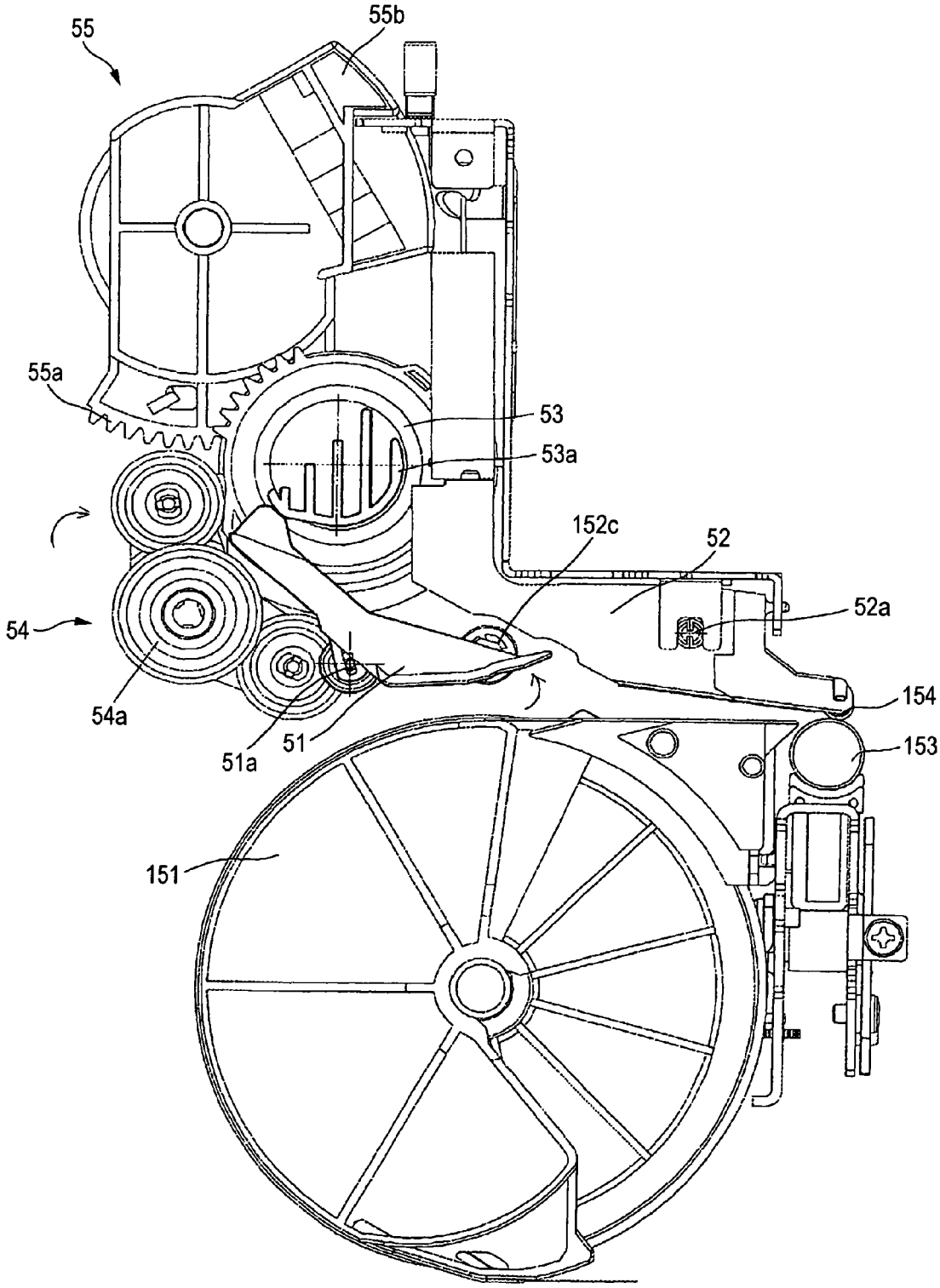

FIGS. 9 and 10 show a case that only the follower roller 152*c* is caused to operate. FIG. 9 shows a state that the follower roller 152*c* is in contact with the sub roller 151 and the follower roller 154 is in contact with the sheet feeding roller 153. In this state, the planetary gear 54*a* is separated from the intermittent gear 53*c* and the cam 53*a* is separated from the other end of the pivot member 51. The lever 55*b* is located at a contact position, and the cam 53*b* is separated from the other end of the pivot member 52 (not shown in FIG. 9).

FIG. 10 shows a state that the planetary gear 54*a* has been driven by the motor (not shown) and is thereby meshed with the intermittent gear 53*c*. As a result, the cam 53*a* pushes the other end of the pivot member 51 and hence the follower roller 152*c* which is pivotally supported by the pivot member 51 at the one end is separated from the sub roller 151.

When a recording sheet is supplied, to reliably deliver it from the sub roller 151 to the sheet feeding roller 153, it is necessary that as shown in FIG. 9 the follower roller 152*c* be in contact with the sub roller 151 and the follower roller 154 be in contact with the sheet feeding roller 153. On the other hand, when recording is performed on a recording sheet, it is necessary that as shown in FIG. 10 the follower roller 152*c* be separated from the sub roller 151 and the follower roller 154 be in contact with the sheet feeding roller 153, because contact of the follower roller 152*c* to the sub roller 151 would adversely affect the sheet feed accuracy.

Figure 11:
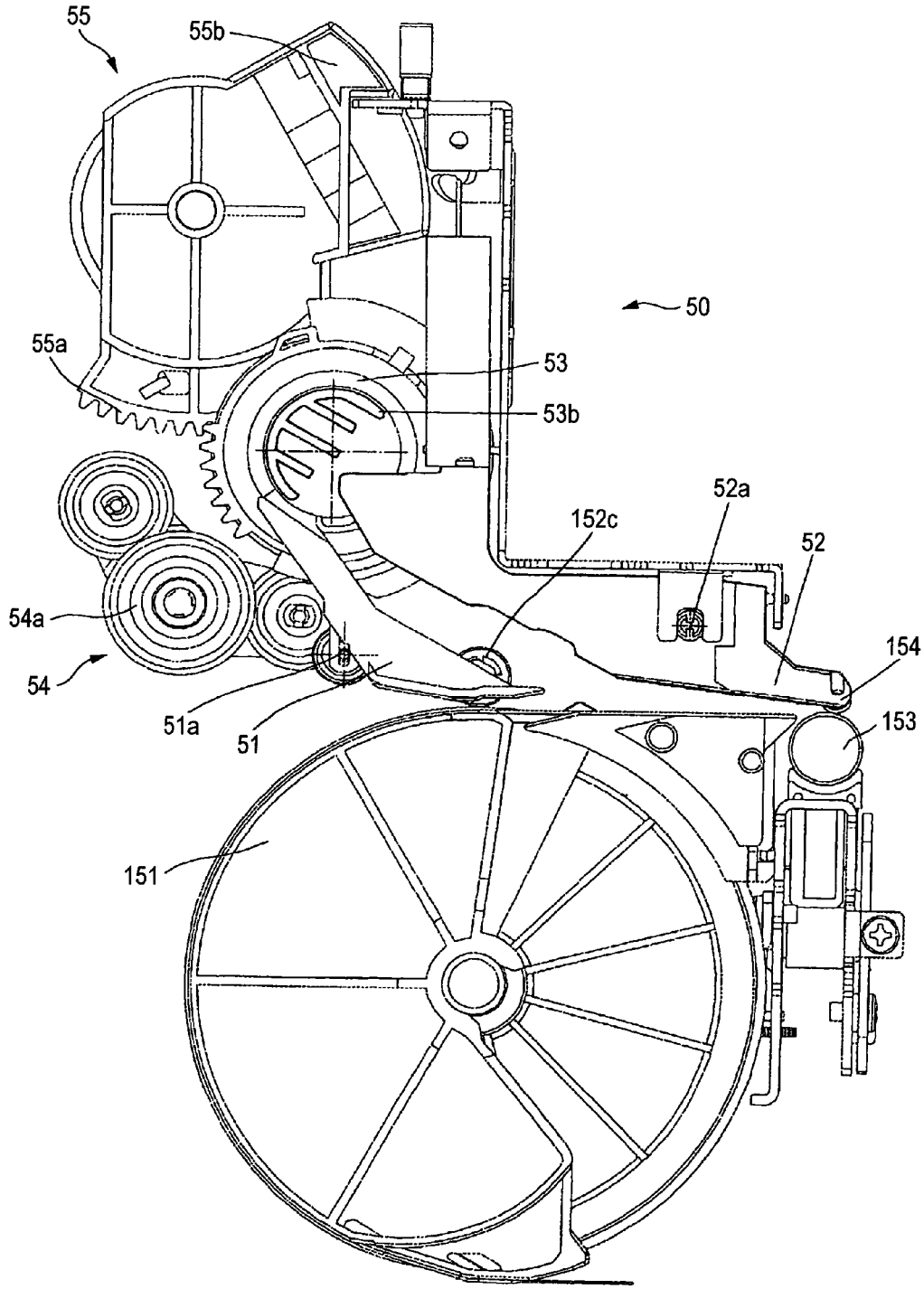
FIGS. 11 and 12 are section views showing a case where both of follower rollers of the sub roller and the sheet feeding roller in the printer of FIG. 7 are operated.
Figure 12:
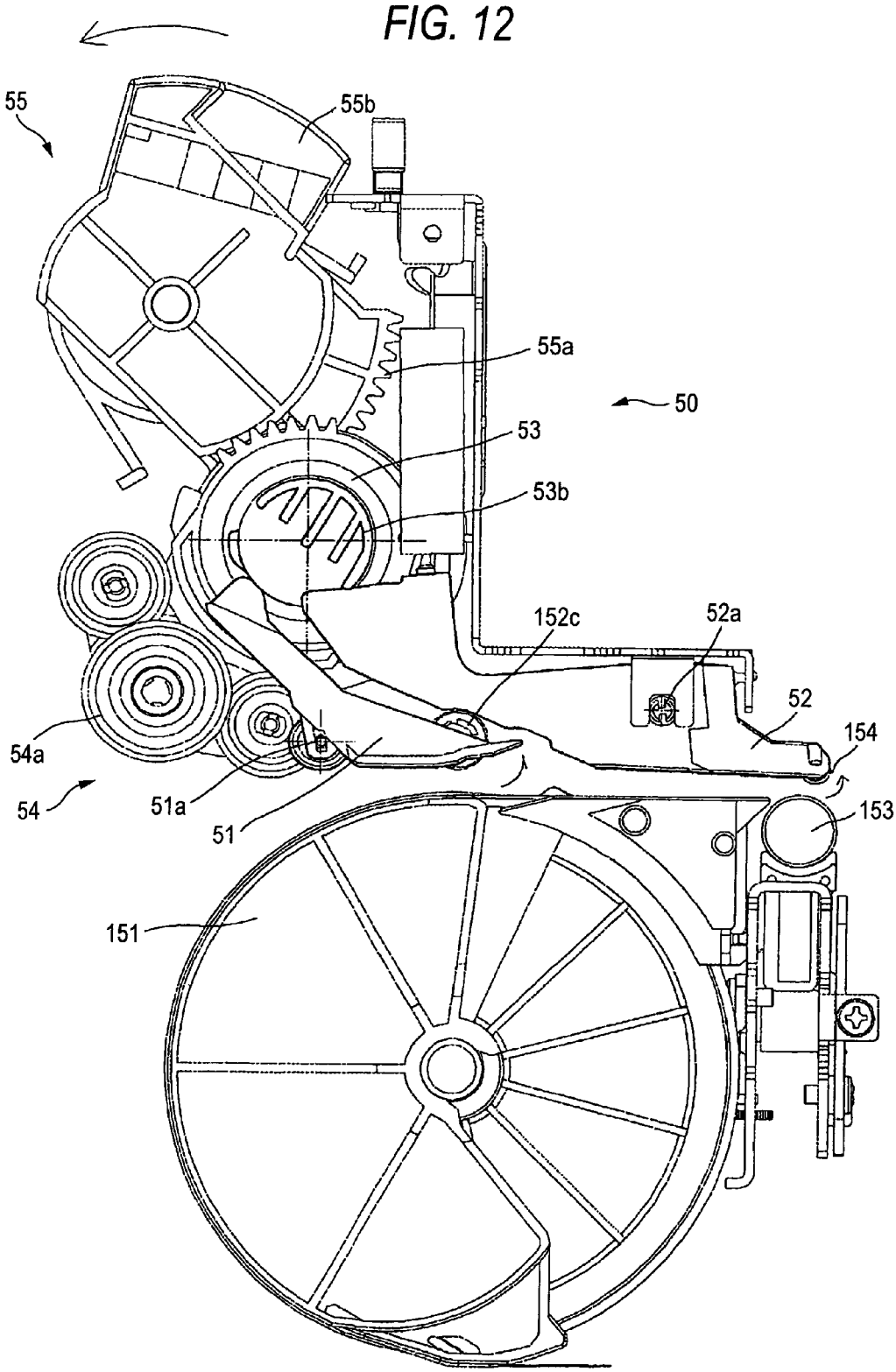

FIGS. 11 and 12 show a case that the follower rollers 152*c* and 154 are caused to operate simultaneously. FIG. 11 shows a state that the follower roller 152*c* is in contact with the sub roller 151 and the follower roller 154 is in contact with the sheet feeding roller 153. In this state, the planetary gear 54*a* is separated from the intermittent gear 53*c* and the cam 53*a* is separated from the other end of the pivot member 51 (not shown in FIG. 11). The lever 55*b* is located at the contact position, and the cam 53*b* is separated from the other end of the pivot member 52.

FIG. 12 shows a state that the lever 55*b* is moved manually from the contact position to a release position, whereby the gear 55*a* is meshed with the intermittent gear 53*d* and rotates the latter. As a result, the cam 53*a* (not shown in FIG. 12) pushes the other end of the pivot member 51 and hence the follower roller 152*c* which is pivotally supported by the pivot member 51 at the one end is separated from the sub roller 151. Further, since the cam 53*b* pushes the other end of the pivot member 52 and hence the follower roller 152*c* which is pivotally supported by the pivot member 52 at the one end is separated from the sheet feeding roller 153.

When a recording sheet is supplied, to reliably deliver it from the sub roller 151 to the sheet feeding roller 153, it is necessary that as shown in FIG. 11 the follower roller 152*c* be in contact with the sub roller 151 and the follower roller 154 be in contact with the sheet feeding roller 153. On the other hand, when a sheet is fed manually, it is necessary that as shown in FIG. 12 the follower rollers 152*c* and 154 be separated from the sub roller 151 and the sheet feeding roller 153, respectively, because the sheet would interfere with the follower rollers 152*c* and 154 if the follower rollers 152*c* and 154 were in contact with the sub roller 151 and the sheet feeding roller 153, respectively.

Figure 14:
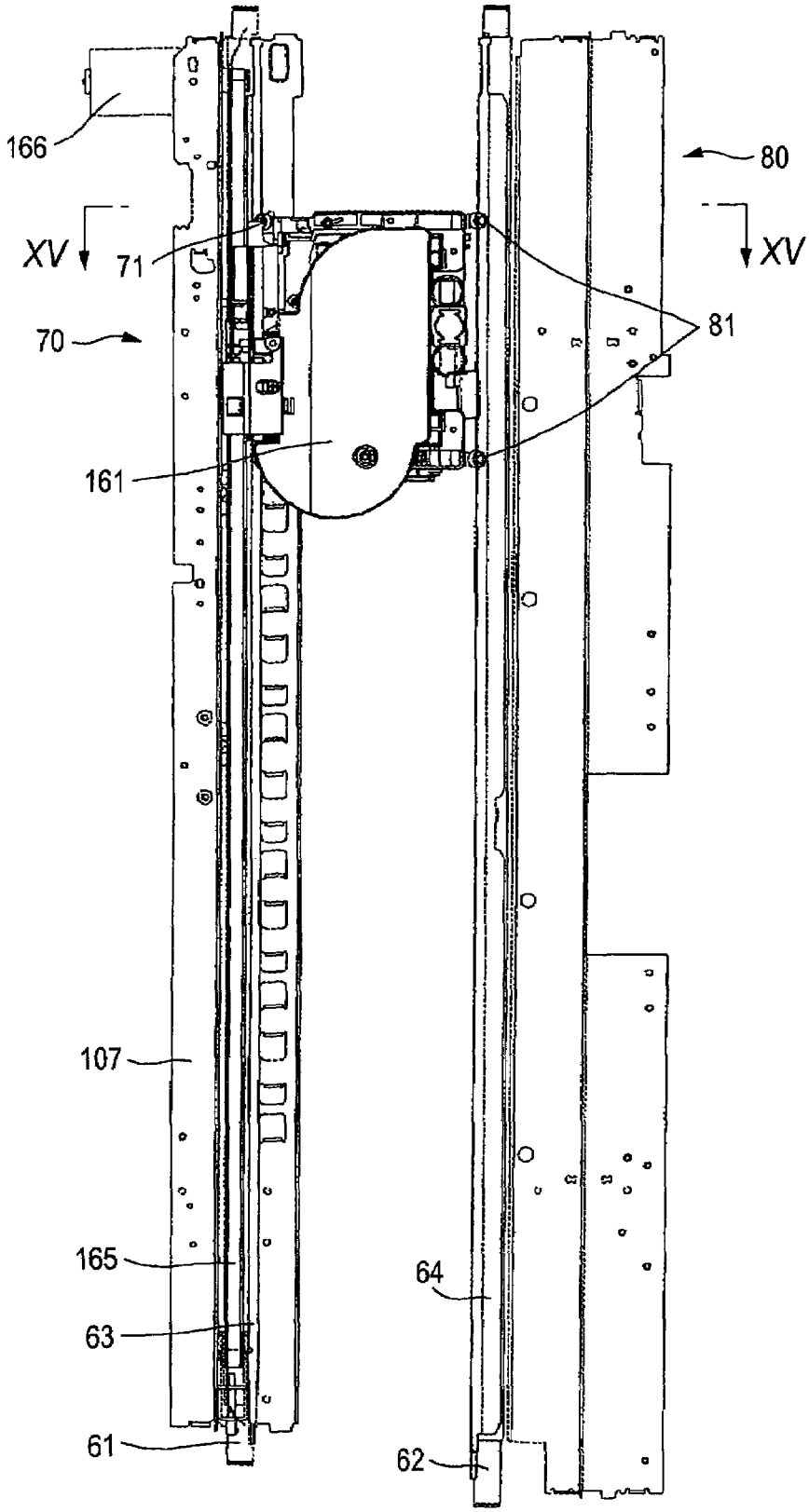
FIG. 14 is a plan view of the configuration shown in FIG. 13.
Figure 15:
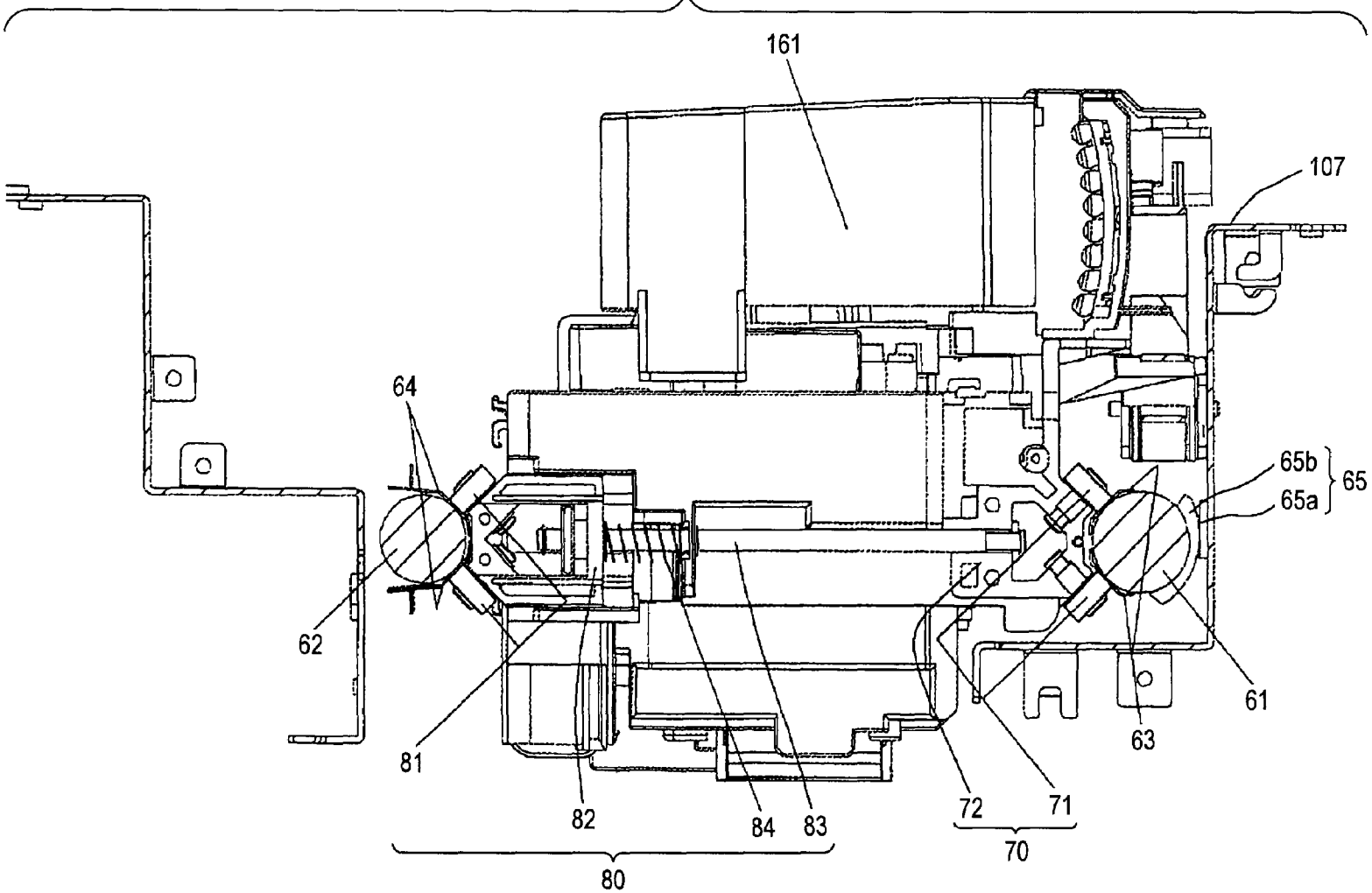
FIG. 15 is a section view taken along a line XV-XV in FIG. 14.

As shown in FIGS. 13 to 15, the main guide shaft 61 is disposed behind the carriage 161 so as to extend in the primary scanning direction and the auxiliary guide shaft 62 is disposed in front of the carriage 161 so as to extend approximately parallel with the main guide shaft 61. The main guide shaft 61 and the auxiliary guide shaft 62 assume circular rod shapes, and both ends of each of the main guide shaft 61 and the auxiliary guide shaft 62 are supported by and fixed to side frames (not shown).

The main guide shaft 61 is provided with main guide plates 63 that assume elongated rectangular shapes and extend from one end to the other end of the main guide shaft 61, and the auxiliary guide shaft 62 is provided with auxiliary guide plates 64 that assume elongated rectangular shapes and extend from one end to the other end of the auxiliary guide shaft 62. More specifically, two main guide plates 63 are arranged side by side in the circumferential direction so as to cover an approximately half of a circumferential face of the main guide shaft 61 a side of which faces the carriage 161, and two auxiliary guide plates 64 are arranged side by side in the circumferential direction so as to cover an approximately half of a circumferential face of the auxiliary guide shaft 62 a side of which faces the carriage 161. That is, the two main guide plates 63 and the two auxiliary guide plates 64 are arranged so as to cover top portions and bottom portions of the approximately half of the circumferential faces of the main guide shaft 61 and the auxiliary guide shaft 62 opposing to each other.

Both longer-side end portions of each main guide plate 63 and those of each auxiliary guide plate 64 are slightly bent toward the main guide shaft 61 or the auxiliary guide shaft 62 so as to form a generally C-shaped cross section. With this sectional shape, when the main guide plates 63 and the auxiliary guide plates 64 are attached to the circumferential faces of the main guide shaft 61 and the auxiliary guide shaft 62, both longer-side end portions of each main guide plate 63 and those of each auxiliary guide plate 64 contact the circumferential face of the main guide 61 or the auxiliary guide 62 and central portions of the main guide plates 63 and the auxiliary guide plates 64 are slightly separated from the circumferential faces of the main guide shaft 61 and the auxiliary guide shaft 62 to provide play therebetween. Both ends of each main guide plate 63 and those of each auxiliary guide plate 64 are also supported by the above-mentioned side frames, and providing play in these support portions enables sheet metal alignment.

The carriage 161 is provided with slide members 70 having the same structure on the back side at the two end positions in the primary scanning direction, as well as with slide members 80 having the same structure on the front side at the two end positions in the primary scanning direction. In each slide member 70, two radial bearings 71 are attached to a fixed seat 72 that is screwed to the carriage 161 and are arranged and oriented so as to form approximately a right angle in the vertical plane containing those. That is, the two radial bearings 71 are pivotally supported by the fixed seat 72 so as to be brought into contact with the two respective main guide plates 63 attached to the main guide shaft 61 and to be able to slide in the longitudinal direction of the main guide plates 63.

In each slide member 80, two radial bearings 81 are attached to a movable seat 82 that is movably attached to the carriage 161 and are arranged and oriented so as to form approximately a right angle in the vertical plane containing those. That is, the two radial bearings 81 are pivotally supported by the movable seat 72 so as to be brought into contact with the two respective auxiliary guide plates 64 attached to the auxiliary guide shaft 62 and to be able to slide in the longitudinal direction of the auxiliary guide plates 64. One end portion of each of shafts 83 is fixed to the fixed seat 72 and the other end portion penetrates through the movable seat 82 with a spring 84 interposed in between. The movable seats 82 are thus movable along the respective shafts 83. Play that occurs when each movable seat 82 is moved can be eliminated by adjusting the length of the support portion of the shaft 83 that is close to the movable seat 82.

With the above-configured carriage 161, the slide members 70 and 80 do not directly contact the main guide shaft 61 and the auxiliary guide shaft 62, respectively, which prevents wear of the main guide shaft 61 and the auxiliary guide shaft 62. Therefore, the reciprocation of the carriage 161 in the primary scanning direction can be kept highly accurate. Wear of the main guide plates 63 and the auxiliary guide plates 64 can also be reduced by making those of a material that is less prone to wear such as stainless steel, which also contributes to keeping the reciprocation of the carriage 161 in the primary scanning direction highly accurate.

Since the radial bearings 81 of the slide members 80 press on the auxiliary guide plates 64 attached to the auxiliary guide shaft 62 because of the restoration forces of the springs 84, the reaction forces cause the radial bearings 71 of the slide members 70 to press on the main guide plates 63, whereby the main guide plates 63 are bent by an amount corresponding the play and are pressed against the main guide shaft 61. Therefore, the carriage 161 always slides along the main guide shaft 61 and its reciprocation in the primary scanning direction is kept highly accurate. The use of the radial bearings 71 and 81 instead of conventional thrust bearings contributes to cost reduction.

Since as described above both ends of the main guide shaft 61 are supported by and fixed to the side frames, the main guide shaft 61 may be bent by the loads from the springs 84 that act on the main guide shaft 61 in its radial direction. In view of this, a support member 65 for sustaining the above loads is disposed behind the center of the main guide shaft 61. However, the main guide shaft 61 is made rotatable about an eccentric rotation axis so that the gap between the nozzle formation face of the recording head 162 mounted on the carriage 161 and the recording face of a recording sheet being transported on the guide face 163*a* of the platen 163 is always kept constant even if the recording sheet thickness is varied. Therefore, if a simple support member were disposed behind the center of the main guide shaft 61, a gap might occur between the support member and the main guide shaft 61 depending on the rotation position of the main guide shaft 61. To prevent occurrence of such a gap, the support member 65 has the following structure.

Figure 16:
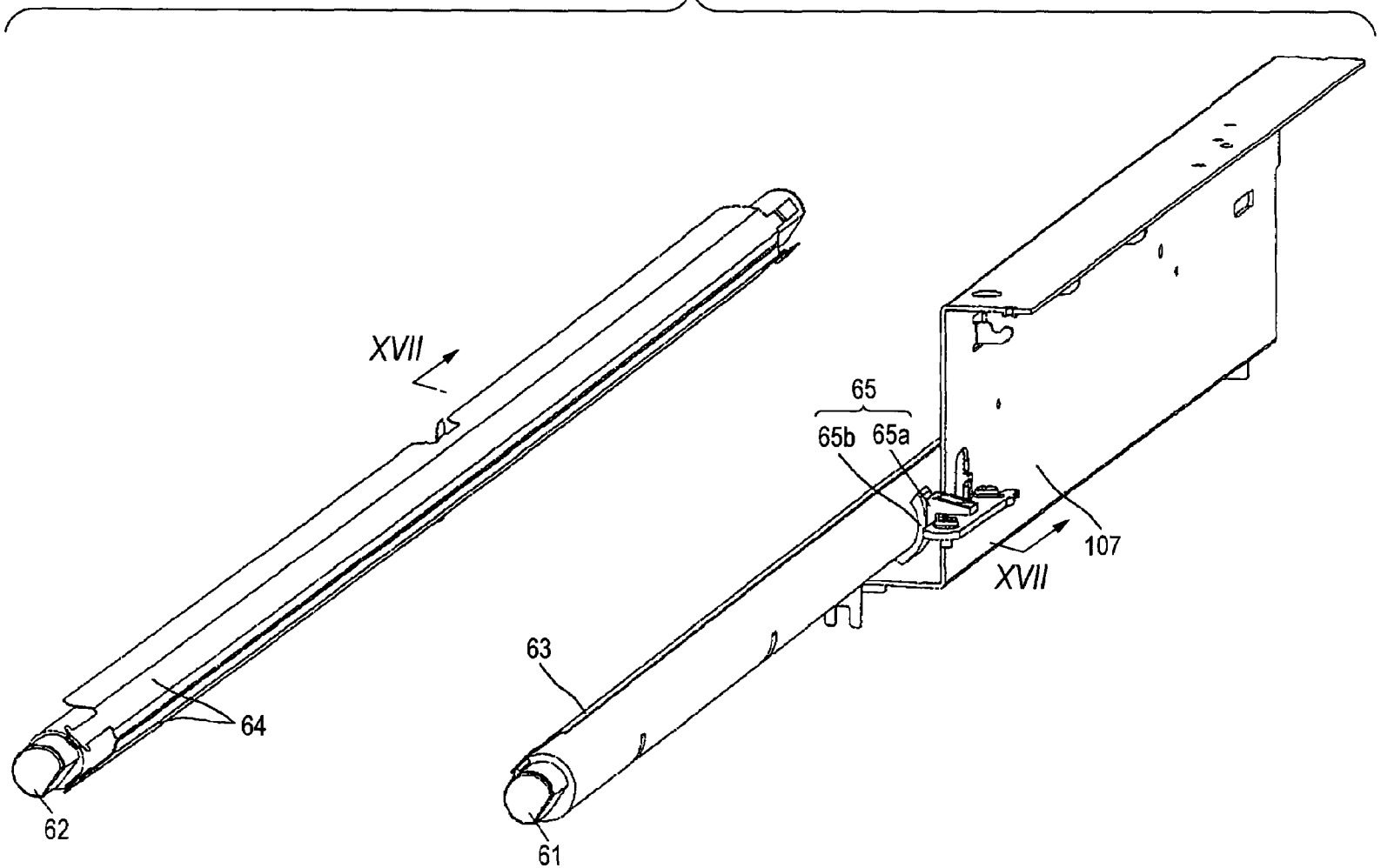
FIG. 16 is a perspective view showing details of a supporting member shown in FIG. 13.

As shown in FIG. 16, the support member 65 is provided with a press member 65*a* and an adjustment member 65*b*. The press member 65*a* is screwed to a frame 107 that is disposed behind the main guide shaft 61. The adjustment member 65*b* is partially buried in the rear side of the main guide shaft 61 at the center. The press member 65*a* and the adjustment member 65*b* contact each other and thereby sustain the loads from the springs 84 that act on the main guide shaft 61 in its radial direction.

Figure 17:
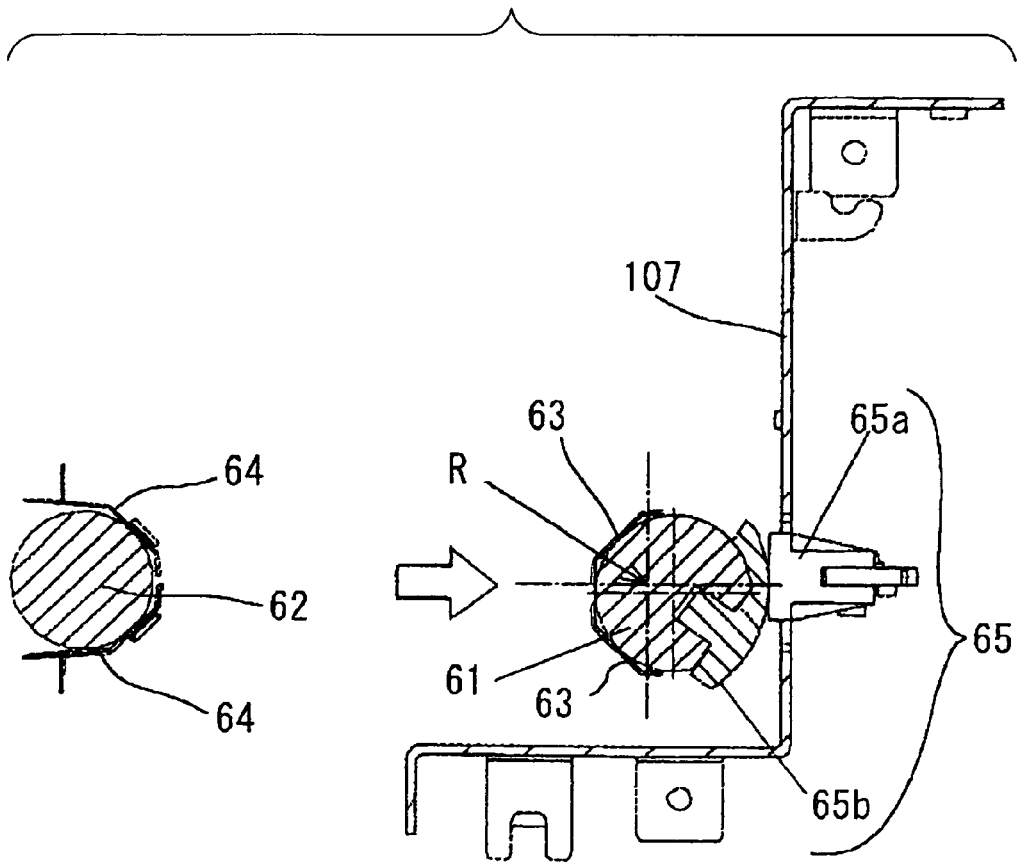
FIG. 17 is a section view taken along a line XVII-XVII in FIG. 16.

Whereas the contact face of the press member 65*a* is flat, the contact face of the adjustment member 65*b* has a curved face whose distance from the eccentric rotation axis R of the main guide shaft 61 is always kept constant, that is, does not vary depending on the rotation position. With this measure, no gap is formed between the support member 65 and the main guide shaft 61 even if the above-mentioned gap adjustment is performed by rotating the main guide shaft 61 about the eccentric rotation axis. Therefore, the support member 65 can always sustain the loads (indicated by an arrow in FIG. 17) from the springs 84 that act on the main guide shaft 61 in its radial direction. The main guide shaft 61 is prevented from being bent by the loads and hence the recording accuracy can be kept high.

As shown in FIG. 18 to 21B, the platen gap adjusting mechanism 170 is equipped with eccentric bushings 171*a*, 171*b*, 172*a*, and 172*b* that support the main guide shaft 61 and the auxiliary guide shaft 62 in an eccentric manner, a belt 173 for synchronously rotating the eccentric bushings 171*a* and 172*a* that are located on one side, and tension pulleys 174 that act on the belt 173 from both sides to give tension to it. The platen gap adjusting mechanism 170 is also equipped with a motor 175, a gear unit 176 for coupling the motor 175 to the eccentric bushings 171*a* and 172*a*, and first fixing members 177 and a second fixing member 178 that fix the main guide shaft 61 and the auxiliary guide shaft 62.

Figure 19A:
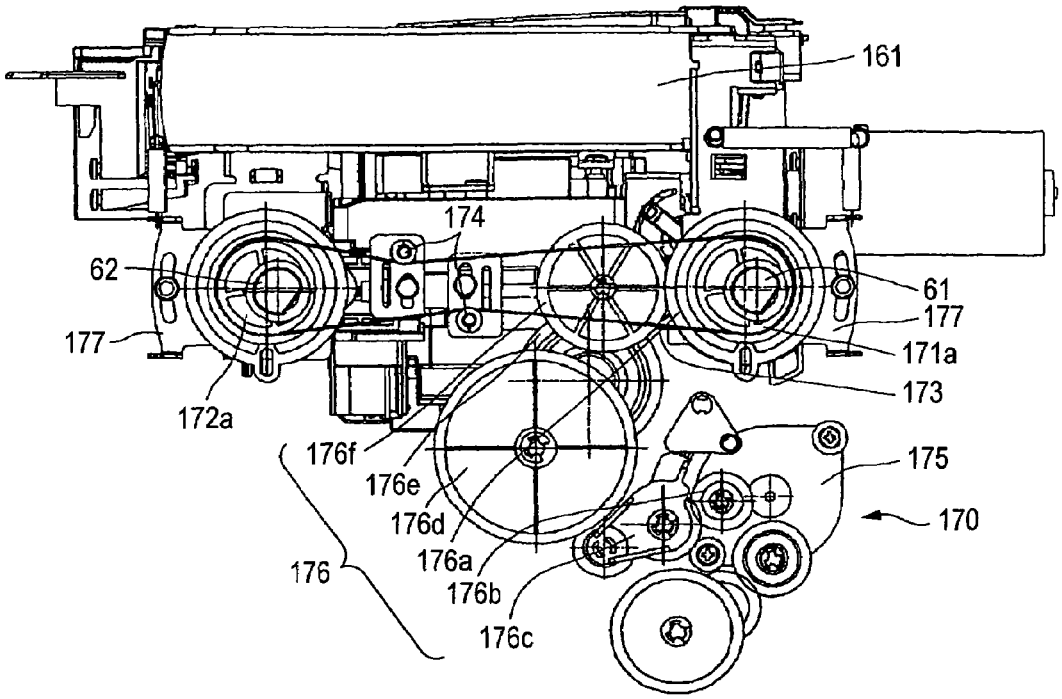
FIG. 19A is a right side view of the configuration shown in FIG. 18.
Figure 19B:
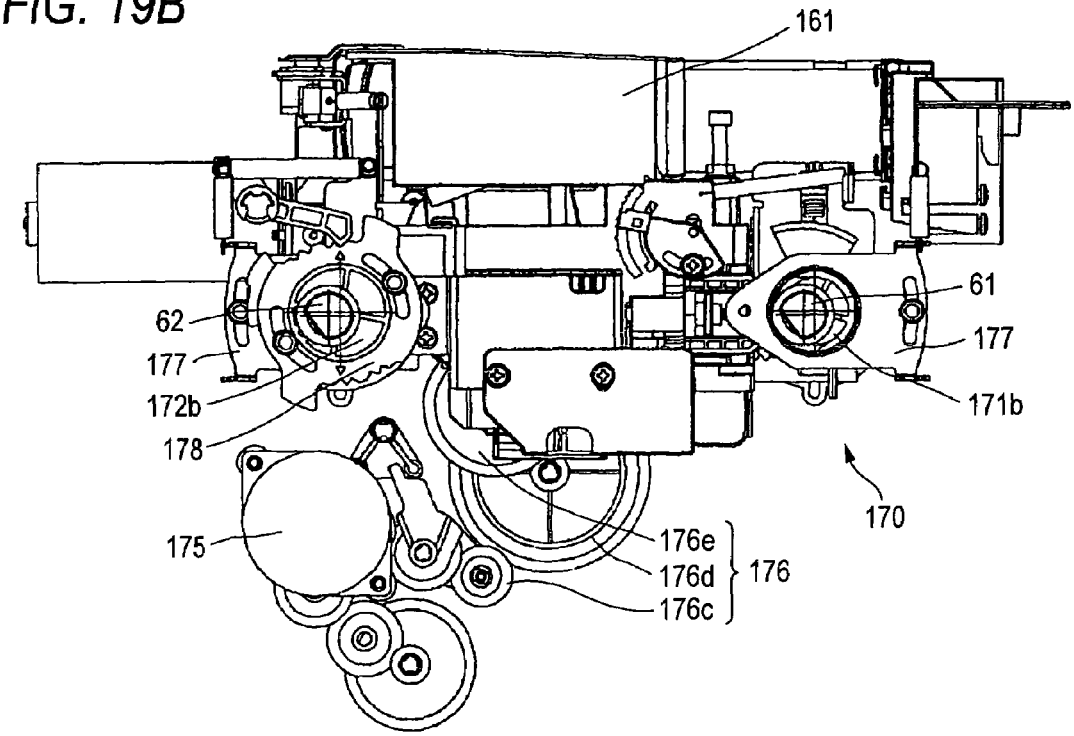
FIG. 19B is a left side view of the configuration shown in FIG. 18.
Figure 20:
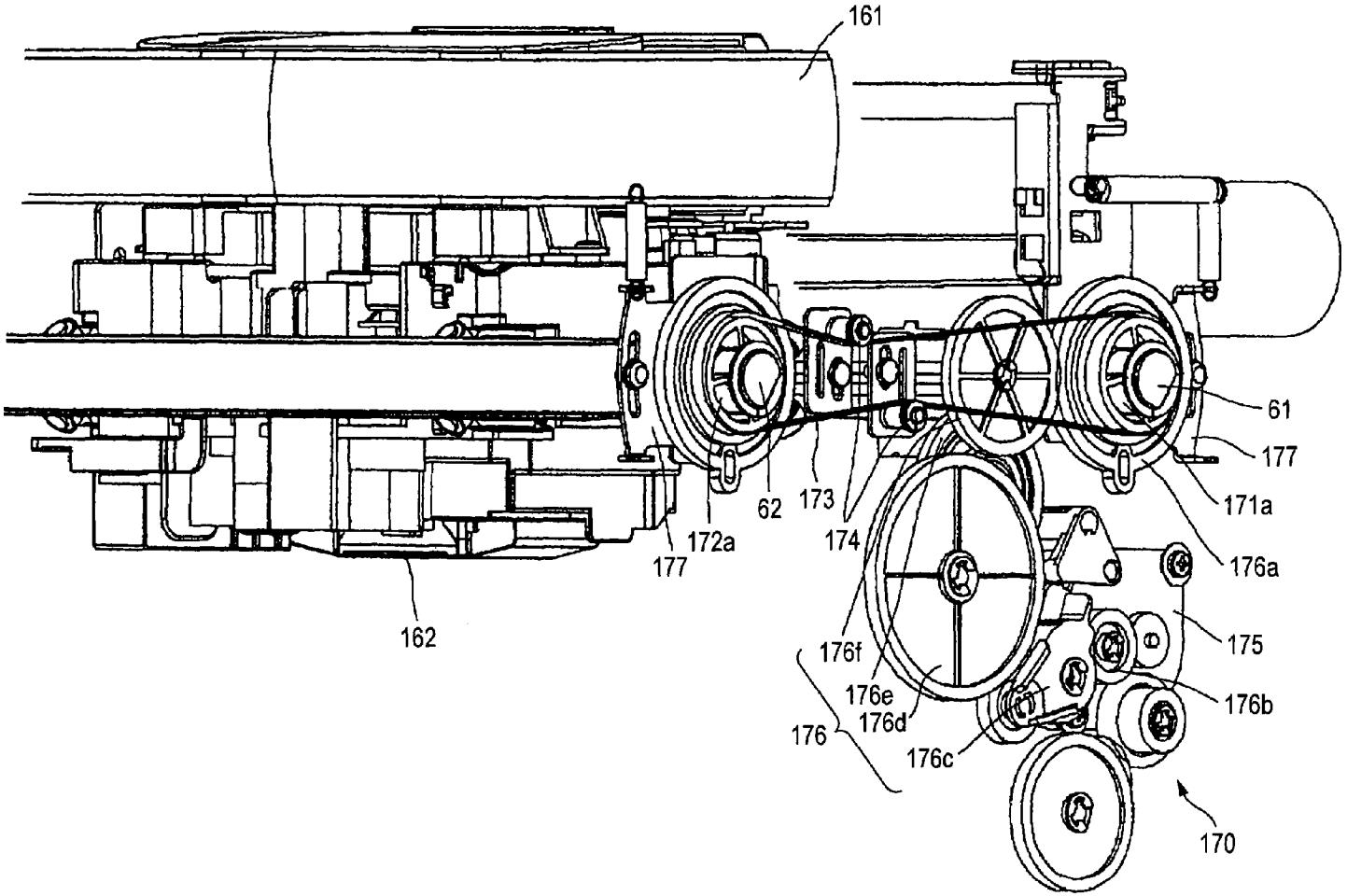
FIG. 20 is a perspective view of the configuration shown in FIG. 19A.
Figure 21A:
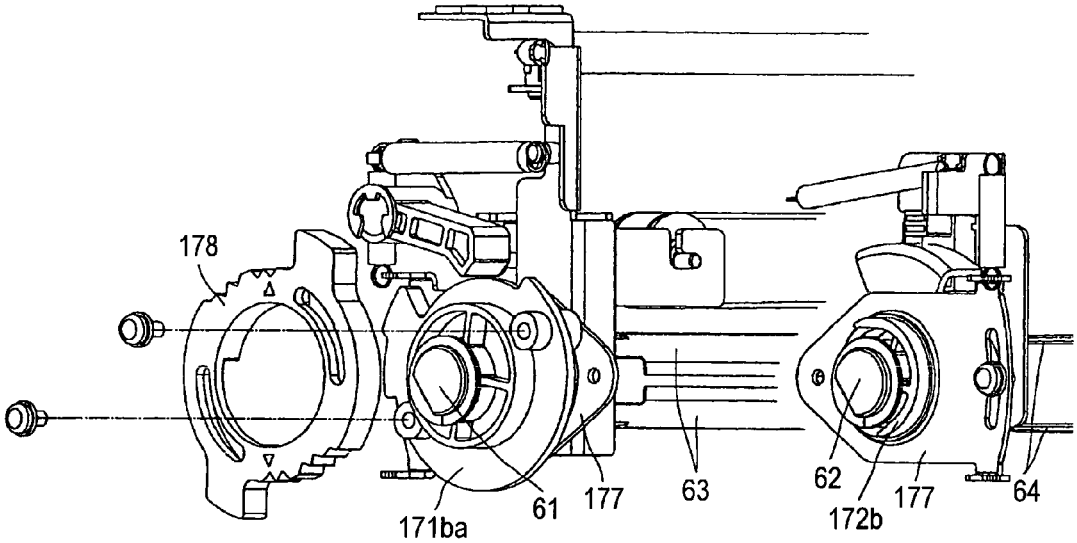
FIGS. 21A and 21B are perspective views of the configuration shown in FIG. 19B.
Figure 21B:
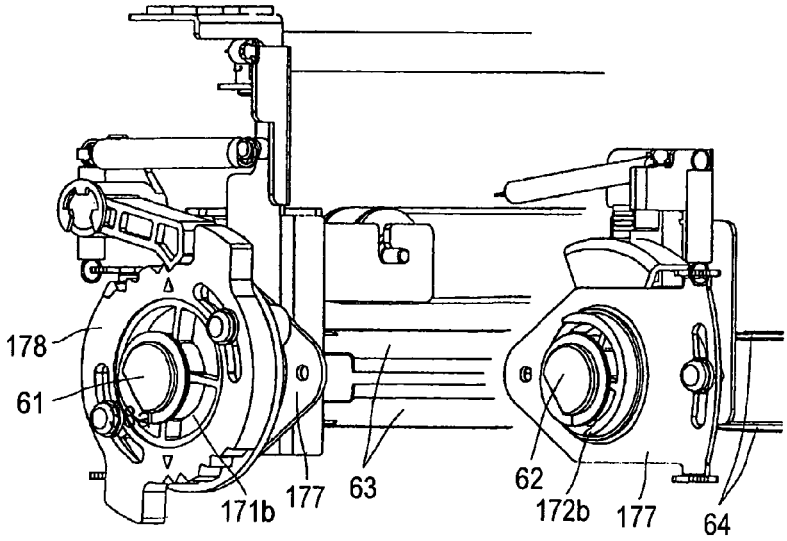

As shown in FIG. 18 to 21B, the two ends of the main guide shaft 61 and the two ends of the auxiliary guide shaft 62 are fixed to the eccentric bushings 171*a*, 171*b*, 172*a*, and 172*b*, respectively, and the eccentric bushings 171*a*, 171*b*, 172*a*, and 172*b* are attached rotatably to the two side frames (not shown). This enables eccentric rotation of the main guide shaft 61 and the auxiliary guide shaft 62. As shown in FIGS. 18 to 20, the belt 173 is stretched between the eccentric bushings 171*a* and 172*a*, which prevents backlash that would otherwise occur in the case where gears are used. The tension pulleys 174 are screwed to the side frame (not shown), which prevents a phase deviation between the main guide shaft 61 and the auxiliary guide shaft 62 when they rotate.

As shown in FIGS. 18 to 20, the gear unit 176 is provided with a bushing gear 176*a* that is fitted with one end of the eccentric bushing 171*a*, a first intermediate gear 176*b* that is in mesh with the motor 175, a planetary gear 176*c* that is in mesh with the first intermediate gear 176*b*, a second intermediate gear 176*d* that meshes with the planetary gear 176*c* intermittently, a third intermediate gear 176*e* that is in mesh with the second intermediate gear 176*d*, and a fourth intermediate gear 176*f* that is in mesh with the third intermediate gear 176*e*. The planetary gear 176*c* has a function of switching between the gap adjustment driving and the switching driving for the switching shafts 14 and 22 plus the release driving for the follower rollers 152*a*, 152*b*, and 152*c* in accordance with the normal/reverse rotation of the motor 175.

As shown in FIG. 18 to 21B, the first fixing members 177 are fixed to the respective eccentric bushings 171*a*, 171*b*, 172*a*, and 172*b*. The first fixing members 177 are screwed to the two side frames (not shown) after the horizontality of the plane defined by the first guide shaft 61 and the second guide shaft 62 is adjusted. As shown in FIGS. 18, 19B, 21A and 21B, the second fixing member 178 is attached to the eccentric bushing 171*b* that is located on the other side. The second fixing member 178 is screwed to a flange 171*ba* that is integral with the eccentric bushing 171*b* after a gap adjustment is performed by eccentric rotation of the main guide shaft 61 and the second guide shaft 62.

During a gap adjustment, the carriage 161 is moved in the vertical direction, which may cause deviation of the main guide plates 63 and the auxiliary guide plates 64 that are provided between the main guide shaft 61 and the second guide shaft 62. However, since the main guide plates 63 and the auxiliary guide plates 64 are attached to the side frames with some play, simplified sheet metal alignment can be performed. Complete sheet metal alignment can then be performed by leveling the main guide plates 63 and the auxiliary guide plates 64 by reciprocating the carriage 161 in the primary scanning direction.

With the above-configured platen gap adjusting mechanism 170, the carriage 161 can be moved in the vertical direction by automatically rotating the main guide shaft 61 and the auxiliary guide shaft 62 in phase in an eccentric manner. Therefore, a highly accurate gap adjustment can be performed so that the gap between the nozzle formation face of the recording head 162 mounted on the carriage 161 and the recording face of a recording sheet being transported on the guide face 163*a* of the platen 163 is always kept constant even if the recording sheet thickness is varied.

During a gap adjustment, a recognition sensor of the carriage 161 is moved in the vertical direction in synchronism with a vertical movement of the carriage 161. A linear encoder scale that is part of a position sensor for the carriage 161 needs to be kept out of contact with a linear encoder that is attached to the carriage 161. Therefore, a mechanism is provided that makes it possible to adjust the position of the linear encoder scale by using levers that are attached to the two respective sides of the linear encoder scale.

Figure 23:
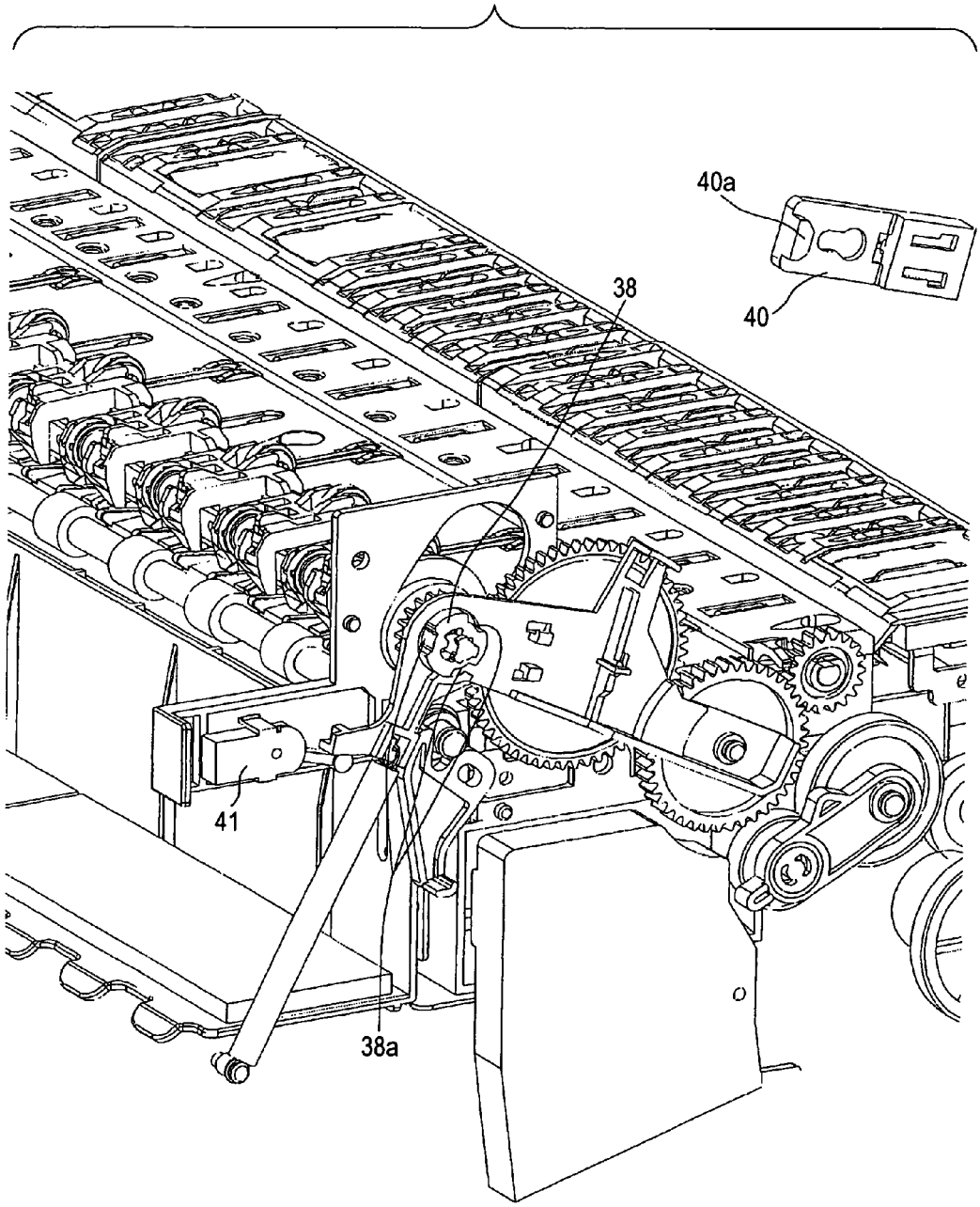

FIGS. 22 and 23 show a detailed structure of the follower roller unit 156. FIG. 23 is different from FIG. 22 in that a lever 40 is removed. The two ends of the switching shaft 14 are rotatably supported by respective frames 15 so as to be movable in elliptical holes 15*a* that are formed in the respective frames 15. Plural sets of a spur roller 11, a smooth roller 12, and a releaser 13 (see FIG. 5) where neither the spur roller 11 nor the smooth roller 12 is provided are arranged in the axial direction at prescribed intervals. In each set, the spur roller 11, the smooth roller 12, and the releaser 13 are disposed around the switching shaft 14 at prescribed intervals in the circumferential direction.

The switching shaft 14 of the follower roller unit 156 and the switching shaft 22 of the support rib unit 164 are rotated interlocking with each other by a gear unit 30. The gear unit 30 is equipped with a roller gear 31 that is fitted with one end of the switching shaft 14, a rib gear 32 that is fitted with one end of the switching shaft 22, a first intermediate gear 33 and a second intermediate gear 34 that are in mesh with each other and with the roller gear 31 and the rib gear 32, respectively, and a planetary gear 35 that meshes with the second intermediate gear 34 intermittently. The planetary gear 35 has a function of switching between the driving for the switching shafts 14 and 22 and the release driving for the follower rollers 152*a*, 152*b*, and 152*c* in accordance with the normal/reverse rotation of the motor (not shown).

The switching shaft 14 of the follower roller unit 156 and the switching shaft 22 of the support rib unit 164 are rotated interlocking with each other by a gear unit 30. The gear unit 30 is equipped with a roller gear 31 that is fitted with one end of the switching shaft 14, a rib gear 32 that is fitted with one end of the switching shaft 22, a first intermediate gear 33 and a second intermediate gear 34 that are in mesh with each other and with the roller gear 31 and the rib gear 32, respectively, and a planetary gear 35 that meshes with the second intermediate gear 34 intermittently. The planetary gear 35 has a function of switching between the driving for the switching shafts 14 and 22 and the release driving for the follower rollers 152*a*, and 152*c* in accordance with the normal/reverse rotation of the motor (not shown).

Figures 24A, 24B, 24C:
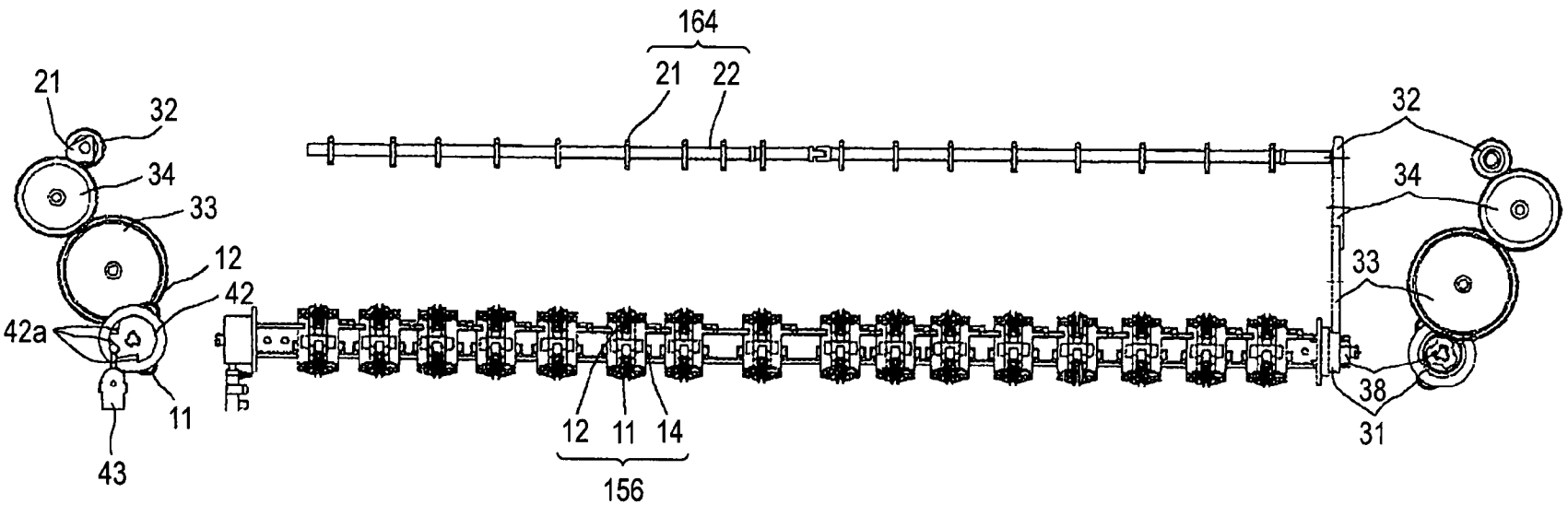
FIG. 24A is a right side view of the follower roller unit and the supporting rib unit.
FIG. 24B is a plan view of the follower roller unit and the supporting rib unit.
FIG. 24C is a left side view of the follower roller unit and the supporting rib unit.

The gear unit 30 is also equipped with an arm 37 that supports the respective shafts of the first intermediate gear 33 and the second intermediate gear 34 and is connected to the frame 15 via a spring 36, a positioning cam 38 (see FIG. 23) that is fitted with the one end of the switching shaft 14, a positioning lever 40 that is connected to the arm 37 via a spring 39 and is locked with the cam 38, and a limit switch 41 that is turned on or off in accordance with the position of the arm 37. As shown in FIGS. 24A to 24C, a phase detection cam 42 that is fitted with the other end of the switching shaft 14 and a limit switch 43 that is turned on or off in accordance with the rotation position of the phase detection cam 42 are also provided.

The spring 36 urges the arm 37 downward, whereby the switching shaft 14 is ordinarily placed at the bottom stationary positions in the holes 15*a*. The circumferential face of the positioning cam 38 is formed with three positioning notches 38*a* that correspond to switching positions for the switching shaft 14, that is, switching positions for the spur rollers 11, the smooth rollers 12, and the releasers 13. The positioning lever 40 is provided with, at one end, a projection 40*a* that is to engage with the positioning notches 38*a* of the positioning cam 38. The positioning lever 40 is slidably attached to the side face of the arm 37 so that the projection 40*a* can slide along the circumferential face of the positioning cam 38.

The spring 39 urges the positioning lever 40 in the sliding direction, whereby the projection 40*a* of the positioning lever 40 is always pressed against the circumferential face of the positioning cam 38. The circumferential face of the phase detection cam 42 is formed with three phase detection cuts 42*a* that correspond to switching positions for the switching shaft 14, that is, switching positions for the spur rollers 11, the smooth rollers 12, and the releasers 13.

With the above gear unit 30, the drive force of the motor 175 is transmitted to the rib gear 32 via the planetary gear 35 and the second intermediate gear 34 as well as to the roller gear 31 via the planetary gear 35, the second intermediate gear 34, and the first intermediate gear 33. Therefore, the switching shafts 22 and 14 are rotated interlocking with each other, whereby the switching between the protrusion and retraction of the support ribs 21 and the switching between the spur rollers 11, the smooth rollers 12, and the releasers 13 can be performed simultaneously. Alternatively, instead of the gear unit, the switching shaft 14 of the follower roller unit 156 and the switching shaft 22 of the support rib unit 164 can be rotated interlocking with each other by using a pulley/belt mechanism.

When switching is performed between the spur rollers 11, the smooth rollers 12, and the releasers 13, the positioning cam 38 and the phase detection cam 42 rotate together with the switching shaft 14, the projection 40*a* of the positioning lever 40 is disengaged from one positioning notch 38*a* of the positioning cam 38 and slides along its circumferential face, and the lever of the limit switch 43 is disengaged from one phase detection cut 42*a* of the phase detection cam 42 and slides along its circumferential face. The fact that the switching operation is being performed can be detected reliably on the basis of a signal from the limit switch 43. If an abnormality that the switching shaft 14 goes up from the bottom stationary positions in the holes 15*a* occurs due to a certain external cause, the arm 37 is separated from the limit switch 41. Therefore, the occurrence of the abnormality can be detected reliably on the basis of a signal from the limit switch 41.

The switching between the spur rollers 11, the smooth rollers 12, and the releasers 13 is completed when the projection 40*a* of the positioning lever 40 is brought into engagement with another positioning notch 38*a* of the positioning cam 38 and the lever of the limit switch 43 is brought into engagement with another phase detection cut 42*a* of the phase detection cam 42. Since as described above the projection 40*a* of the positioning lever 40 is engaged with the positioning notches 38*a* of the positioning cam 38, the spur rollers 11, the smooth rollers 12, and the releasers 13 can be set reliably to the prescribed phases. Further, the completion of the above switching operation can be detected reliably on the basis of a signal from the limit switch 43.

Figure 25A:
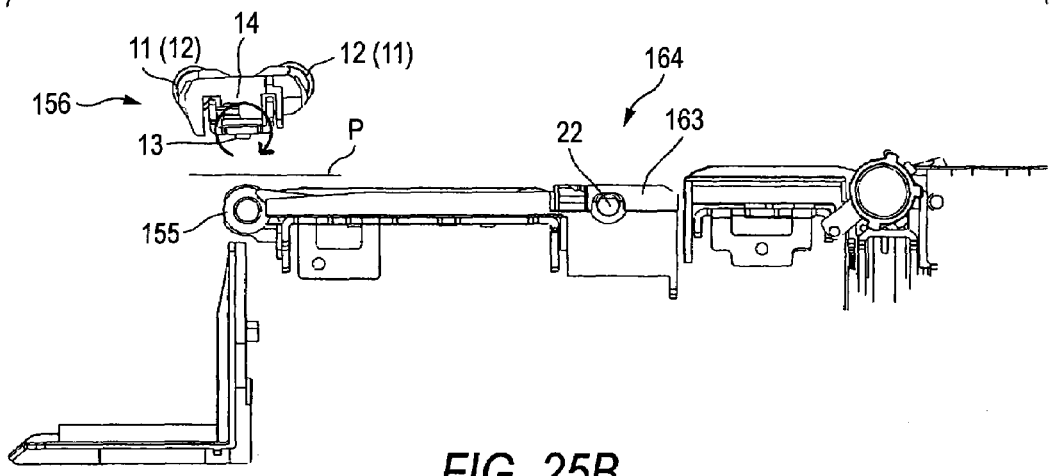
FIGS. 25A to 25C are side views showing state switchings of the follower roller unit and the supporting rib unit.
Figure 25B:
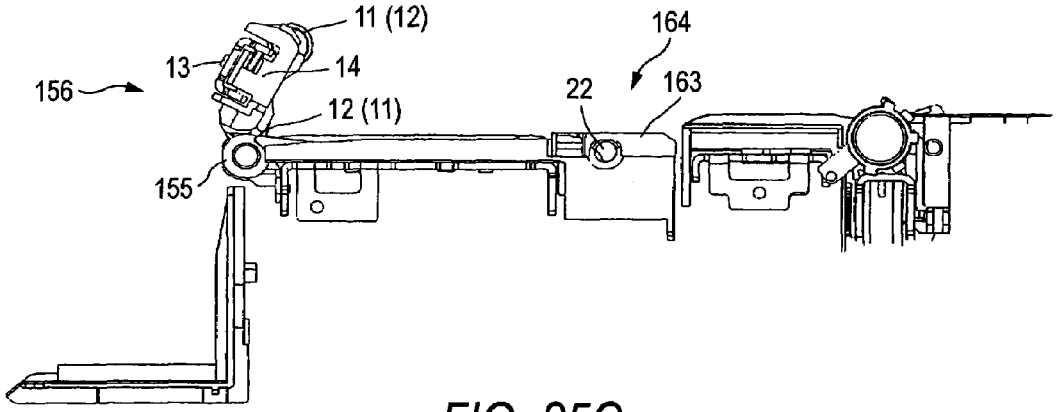

FIG. 25A shows a state that the follower roller unit 156 is switched to the releasers 13 and the spur rollers 11 and the smooth rollers 12 are separated from the sheet ejecting roller 155 and that in the support rib unit 164 the support ribs 21 are retracted from the guide face 163*a* of the platen 163. FIG. 25B shows a state that the follower roller unit 156 is switched to the spur rollers 11 or the smooth rollers 12 and the spur rollers 11 or the smooth rollers 12 are in contact with the sheet ejecting roller 155 and that in the support rib unit 164 the support ribs 21 are retracted from the guide face 163*a* of the platen 163.

Figure 25C:
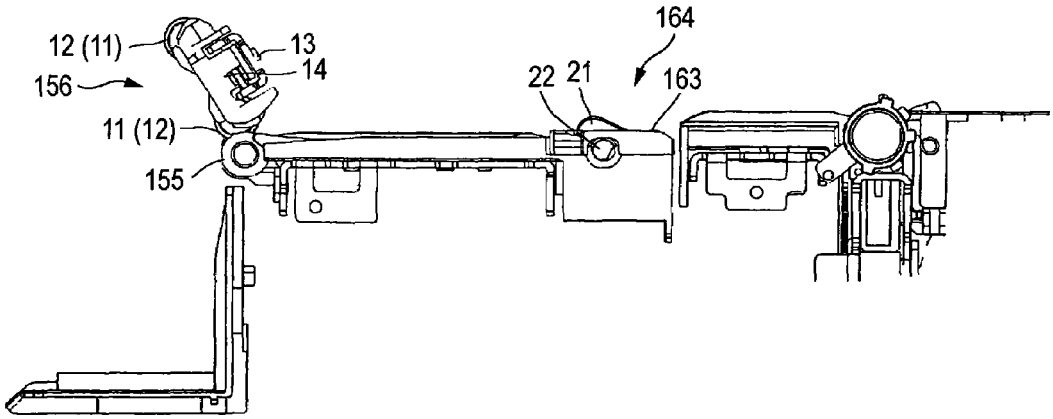

FIG. 25C shows a state that the follower roller unit 156 is switched to the spur rollers 11 or the smooth rollers 12 and the spur rollers 11 or the smooth rollers 12 are in contact with the sheet ejecting roller 155 and that in the support rib unit 164 the support ribs 21 are protruded from the guide face 163*a* of the platen 163. This kind of switching makes it possible to realize a sheet ejection form that is most suitable for the attribute of a recording sheet.

FIG. 26 is a table showing switching states of the follower roller unit 156 and the support rib unit 164 that correspond to respective attributes of recording sheets. As shown in the row of condition 1, where the recording sheet type is a cut sheet and the recording sheet state is "normal," an optimum sheet ejection form can be realized by making switching to the spur rollers 11 and switching the support ribs 21 to a protruded state. This is because normal cut sheets are less prone to jag traces but tend to rise.

As shown in the row of condition 2, where the recording sheet type is a cut sheet and the recording sheet state is "delicate," an optimum sheet ejection form can be realized by making switching to the smooth rollers 12 and switching the support ribs 21 to a protruded state. This is because smooth rollers having smooth circumferential faces are less prone to scratch delicate cut sheets.

As shown in the row of condition 3, where the recording sheet type is a rolled sheet and the recording sheet state is "normal," an optimum sheet ejection form can be realized by making switching to the releasers 13 and switching the support ribs 21 to a retracted state. This is because normal rolled sheet needs to be cut with a cutter and hence interference might occur if the spur rollers 11 or the smooth rollers 12 exist on the path, and normal rolled sheet is curled and hence might rub against the support ribs 21 if they exist in the path.

As shown in the row of condition 4, where the recording sheet type is a rolled sheet and the recording sheet state is "thin," an optimum sheet ejection form can be realized by making switching from the releasers 13 to the spur rollers 11 only during paper ejection and always keeping the support ribs 21 in a retracted state. This is because static electricity tends to occur in thin rolled sheet and hence it may stick to the platen 163 or the like to become hard to eject, and thin rolled sheet is curled and hence might rub against the support ribs 21 if they existed in the path.

As shown in the row of condition 5, where the recording sheet type is a rolled sheet and the recording sheet state is "hygroscopic," an optimum sheet ejection form can be realized by keeping, from recording to paper ejection, a state that switching is made to the spur rollers 11 from the releasers 13 and switching the support ribs 21 to a retracted state. This is because highly hygroscopic roller paper tends to rise because of what is called cockling, and highly hygroscopic roller paper is curled and hence might rub against the support ribs 21 if they exist in the path.

As shown in the row of condition 6, where the recording sheet type is a rolled sheet and rolled sheet is to be cut shortly, an optimum sheet ejection form can be realized by making switching from the releasers 13 to the spur rollers 11 only during paper ejection and always keeping the support ribs 21 in a retracted state. This is because a short-cut part of rolled sheet may play on the platen 163 and become hard to eject, and a shortly cut part of the rolled sheet is curled and hence might rub against the support ribs 21 if they exist in the path.

As shown in the row of condition 7, where the recording sheet type is a hand-fed sheet and the recording sheet state is "thick," an optimum sheet ejection form can be realized by making switching to the releasers 13 and switching the support ribs 21 to a retracted state. This is because thick hand-fed sheets might interfere with the spur rollers 11, the smooth rollers 12, or the support ribs 21 if they exist in the path. The switching of the follower roller unit 156 and the support rib unit 164 can be performed automatically by storing the above kind of data in a controller of the ink jet printer 100 in the form of a table.

In the above-described embodiment, the switching shaft 14 of the follower roller unit 156 and the switching shaft 22 of the support rib unit 164 are rotated interlocking with each other by the gear unit 30. However, the invention is not limited to such a case. Separate gear units or the like may be provided so that the switching shaft 14 of the follower roller unit 156 and the switching shaft 22 of the support rib unit 164 are rotated independently of each other. Further, adaptation to many kinds of recording sheets having respective attributes is possible even if only the follower roller unit 156 is provided, that is, the support rib unit 164 is not provided.

Figure 27:
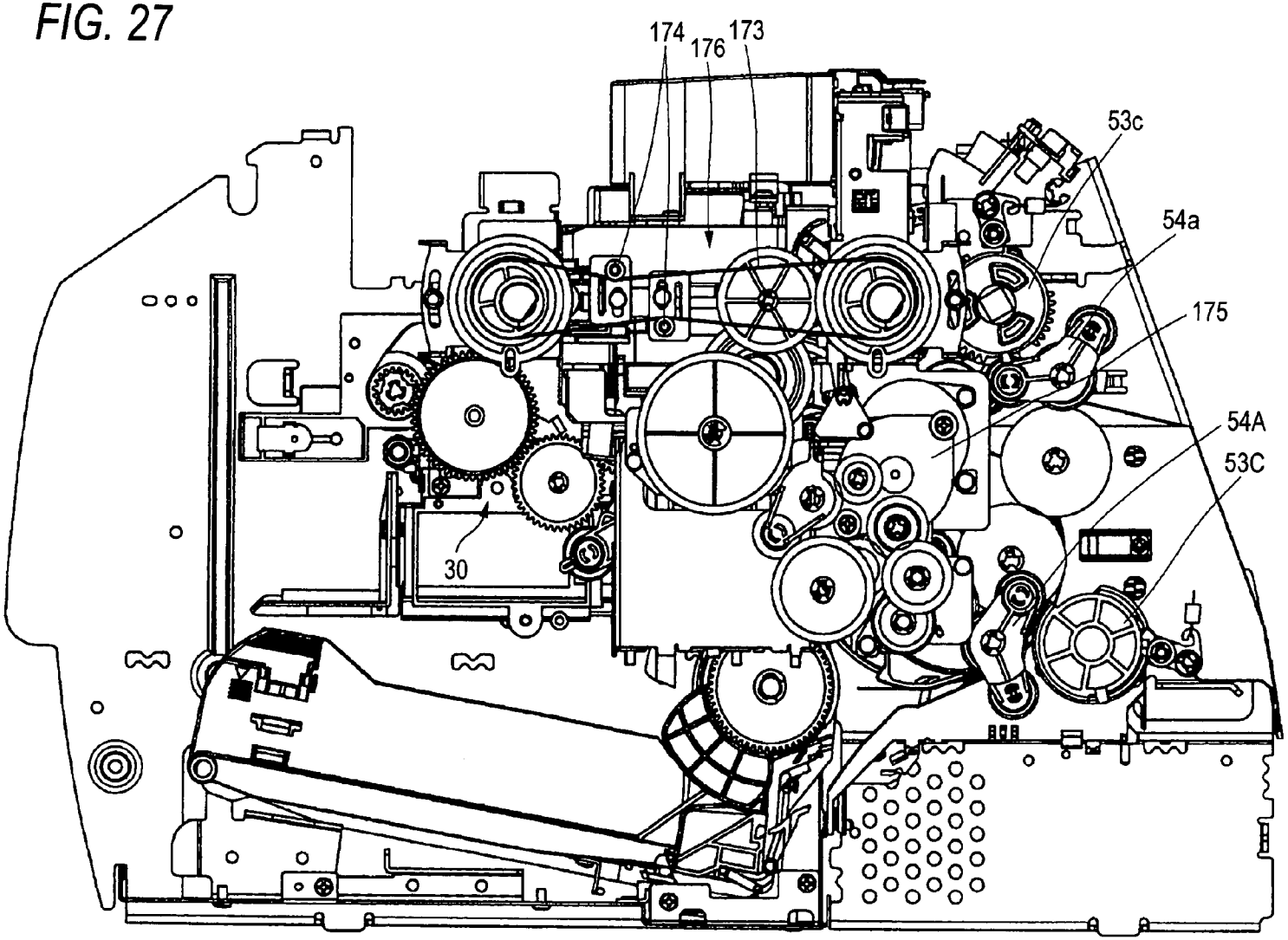
FIG. 27 is a side view showing an entire configuration of the follower roller driving device, the platen gap adjusting mechanism, the follower roller unit and the supporting rib unit in the printer of FIG. 7.
Figure 28:
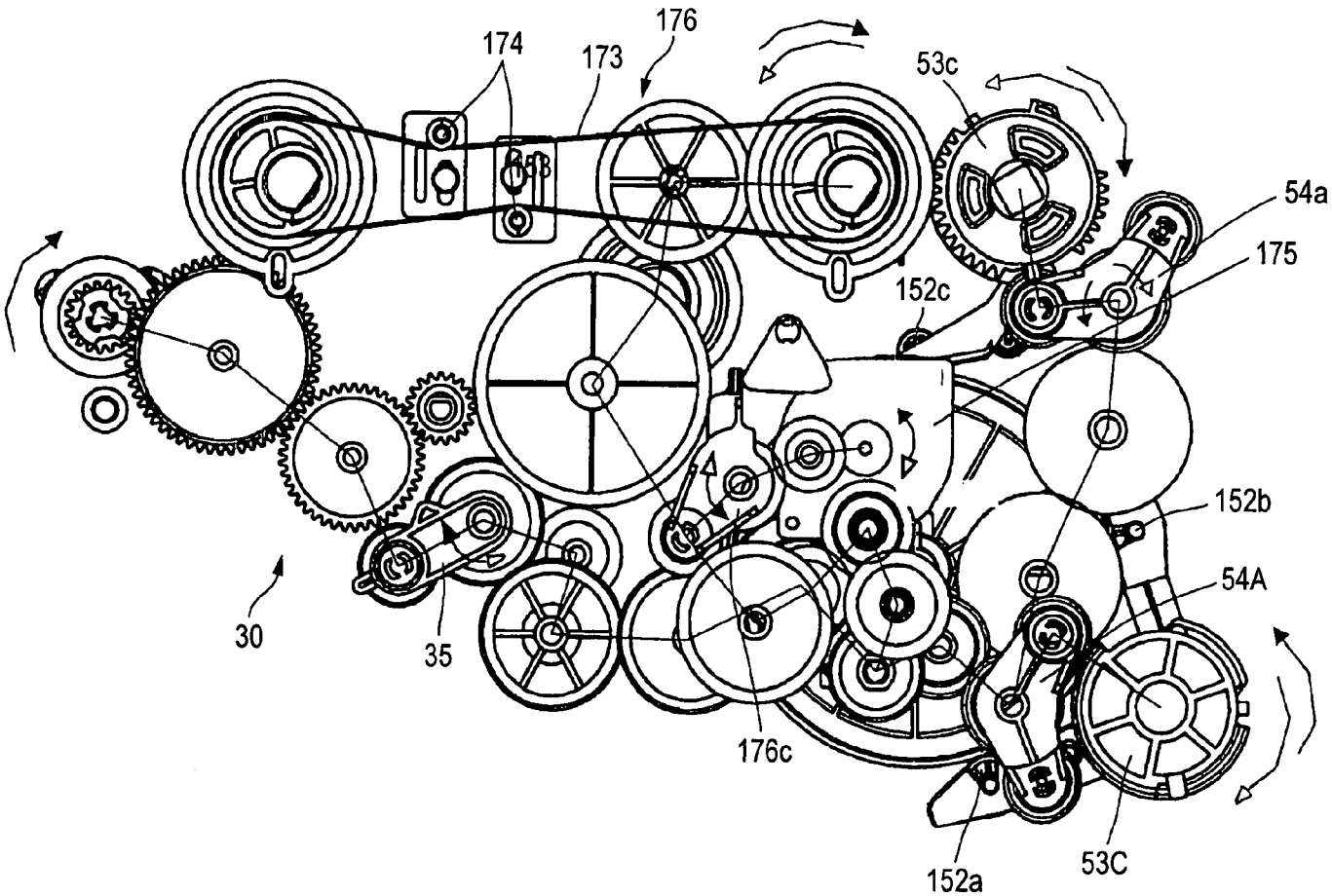
FIG. 28 shows a main part of the configuration shown in FIG. 27.

As shown in FIGS. 27 and 28, the follower roller driving device 50 is equipped with the intermittent gear 53*c* and the planetary gear 54*a* for operating the follower roller 152*c* and an intermittent gear 53C and a planetary gear 54A for operating the follower rollers 152*a* and 152*b*. The platen gap adjusting mechanism 170 is equipped with the belt 173, the tension pulleys 174, and the gear unit 176. The follower roller unit 156 and the support rib unit 164 are coupled to the gear unit 30. The follower roller driving device 50, the platen gap adjusting mechanism 170, the follower roller unit 156, and the support rib unit 164 are driven and switched by the single motor 175.

More specifically, as shown in FIG. 28, if the motor 175 is rotated counterclockwise, the planetary gear 176*c* is moved to such a position as to be able to drive the follower roller driving device 50, the follower roller unit 156, and the support rib unit 164. In this state, if the motor 175 rotated clockwise, the planetary gear 35 is moved to such a position as to be able to drive the follower roller unit 156 and the support rib unit 164. If the motor 175 is rotated counterclockwise, the driving by the planetary gear 35 is suspended. On the other hand, when the motor 175 is rotated clockwise, the planetary gear 54A is moved to such a position as to separate the follower rollers 152*a* and 152*b* from the sub roller 151 and the planetary gear 54*a* is moved to such a position as to separate the follower roller 152*c* from the sub roller 151. When the motor 175 is rotated counterclockwise, the planetary gear 54A is moved to such a position as to bring the follower rollers 152*a* and 152*b* into contact with the sub roller 151 and the planetary gear 54*a* is moved to such a position as to bring the follower roller 152*c* into contact with the sub roller 151.

On the other hand, if first the motor 175 is rotated clockwise, the planetary gear 176*c* is moved to such a position as to be able to drive the platen gap adjusting mechanism 170. In this state, if the motor 175 is rotated clockwise, the platen gap (i.e., the distance between the head face and the platen 163) is increased. If the motor 175 is rotated counterclockwise, the platen gap is decreased.

Figure 30B:
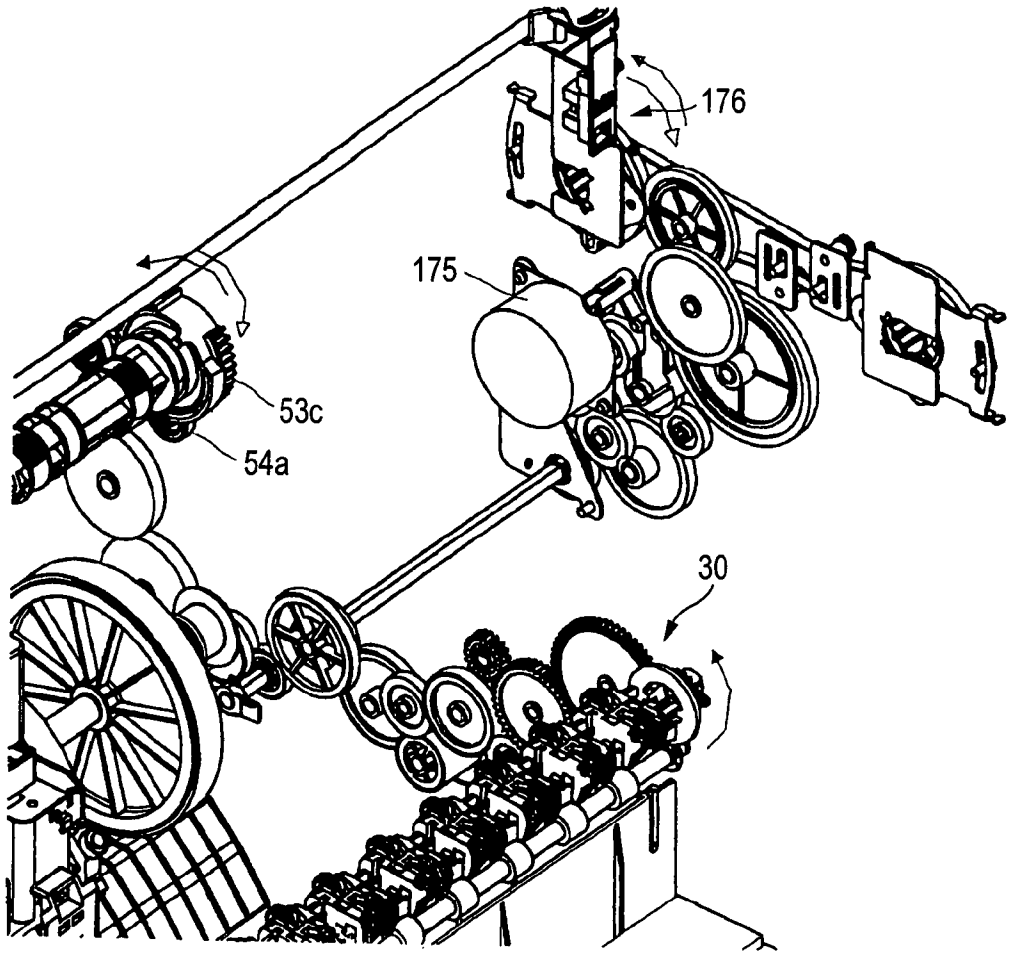
FIGS. 30A and 30B show a main part of the configuration shown in FIG. 29.
Figure 30A:
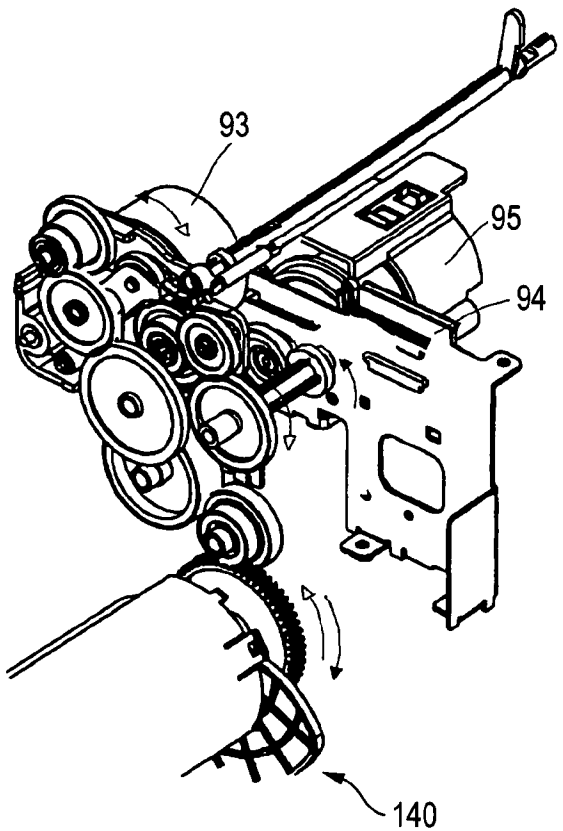

As shown in FIG. 30A, if first a motor 93 is rotated counterclockwise, a planetary gear 91 is moved to such a position as to be able to drive an automatic sheet supplying mechanism including the hopper 141 and the sheet supplying roller 142. In this state, if the motor 93 is rotated counterclockwise, the automatic sheet supplying mechanism operates in the normal rotation direction. If motor 93 is rotated clockwise, the automatic sheet supplying mechanism operates in the reverse rotation direction. On the other hand, if first the motor 93 is rotated clockwise, the planetary gear 91 is moved to such a position as to be able to drive a cleaning mechanism 90. In this state, if the motor 93 is rotated counterclockwise, a wiper is driven. If motor 93 is rotated clockwise, a pump 95 is driven. FIG. 30B is a perspective of the mechanisms shown in FIG. 28.

Figure 29:
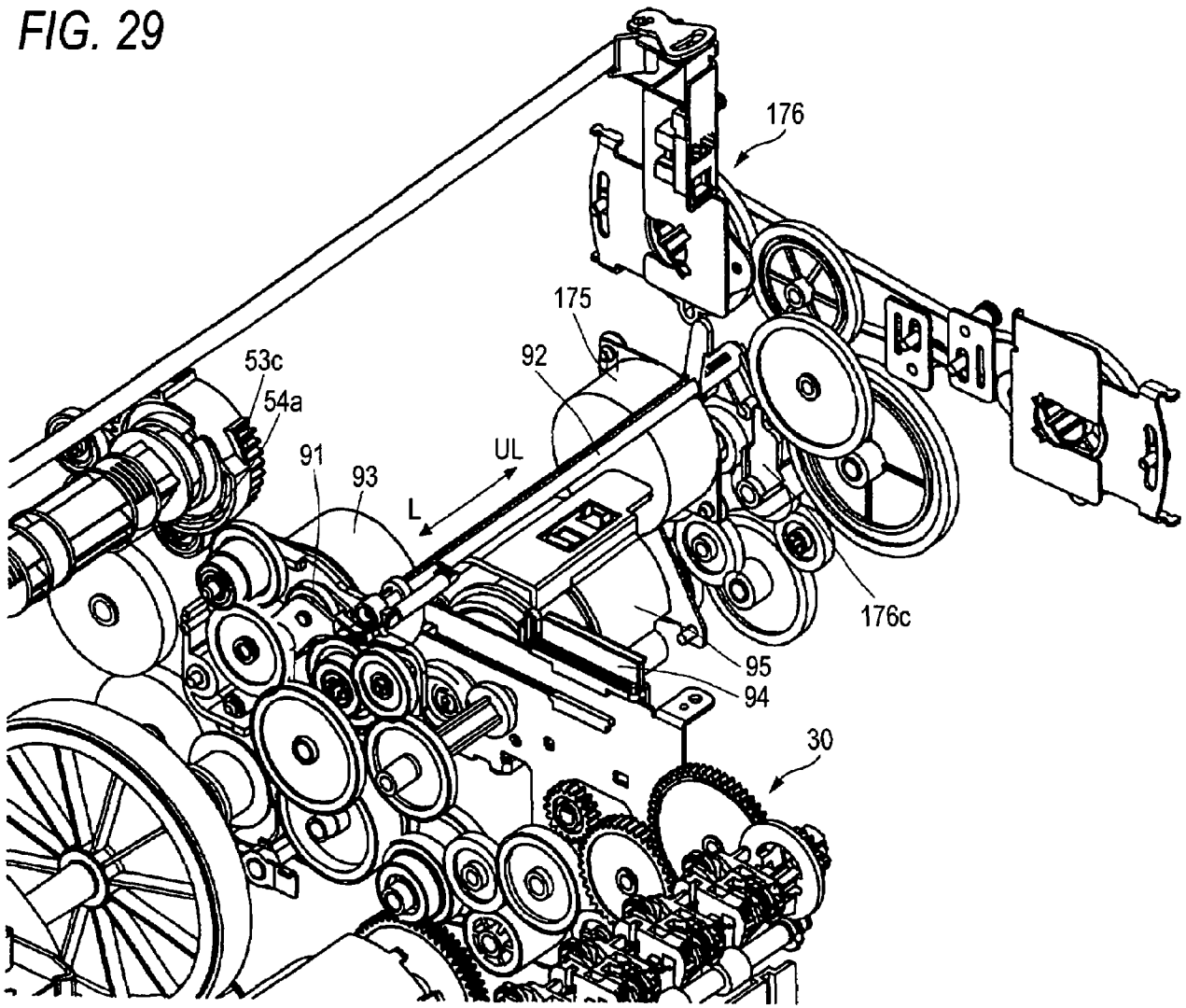
FIG. 29 is a perspective view showing an entire configuration of a mechanism for transmitting a driving force of a motor in the printer of FIG. 7.

The switching between the drive subject switching operation and the drive force transmitting operation that relate to the motors 175 and 93 is made by a lever 92 operated by the carriage 161 as shown in FIG. 29. For the driven subject switching, the lever 92 is moved to an unlock position (indicated by arrow UL). For the drive force transmission, the lever 92 is moved to a lock position (indicated by arrow L).

Figure 31:
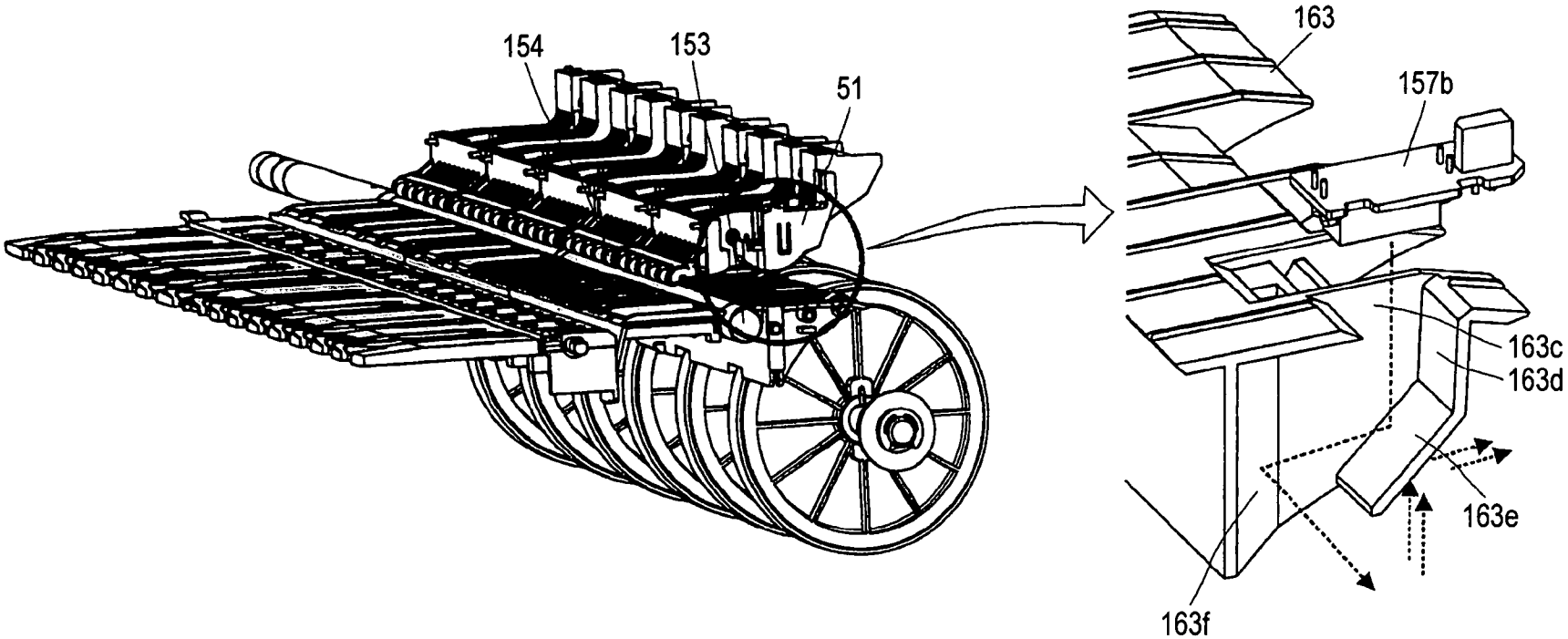
FIG. 31 is a perspective view of a sensor and its periphery in the printer of FIG. 1 or 7.
Figure 32A:
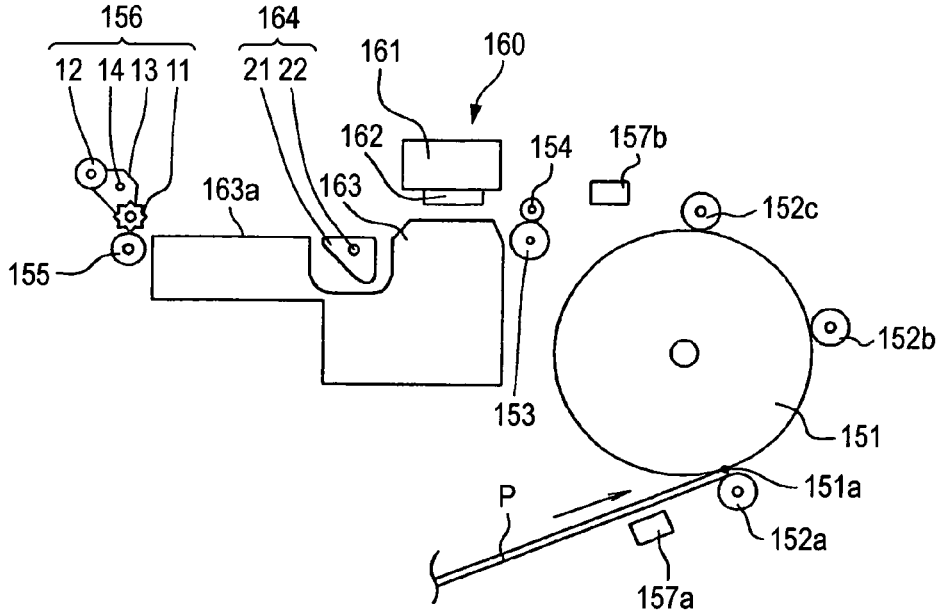
FIGS. 32A to 33B are schematic section views showing a transporting operation of a recording medium in the printer of FIG. 7.
Figure 32B:
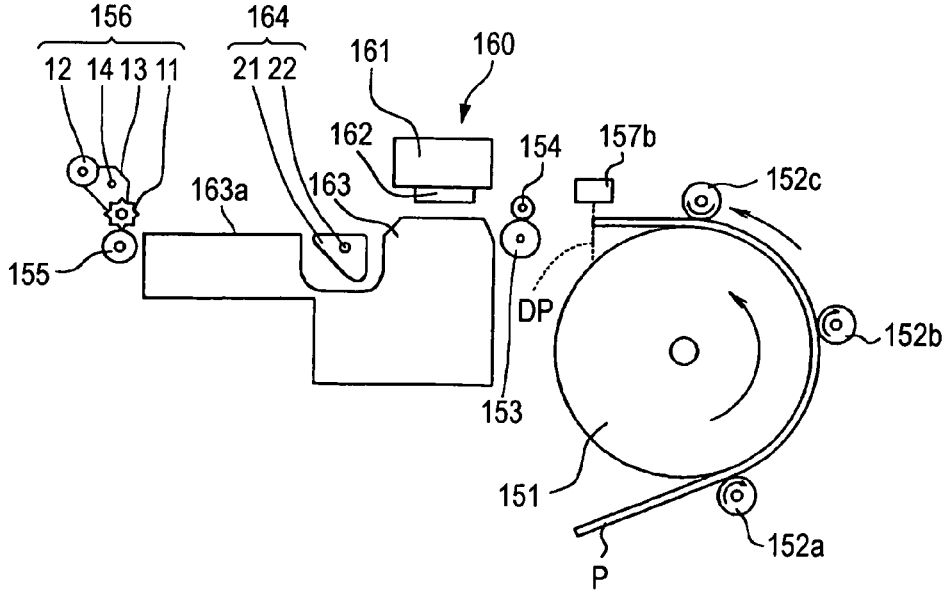
Figure 33A:
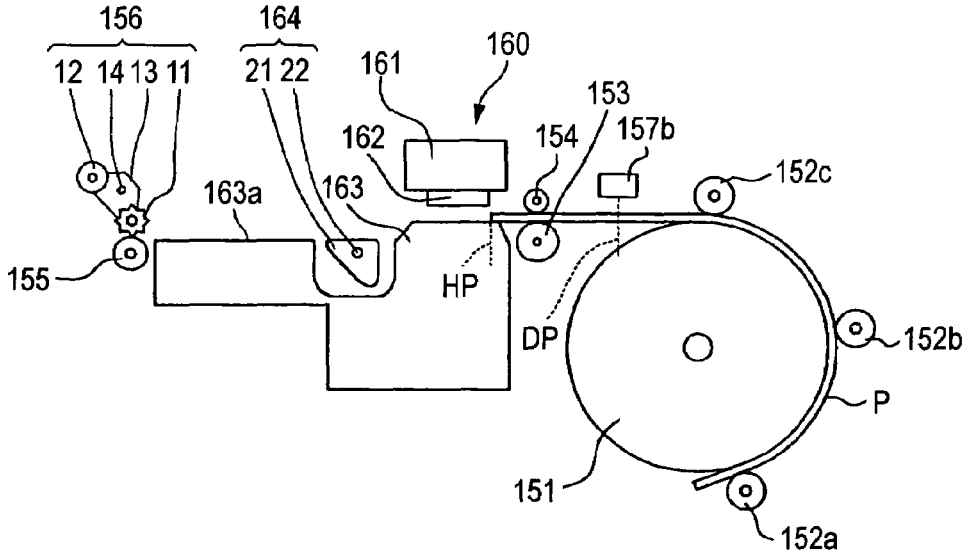
Figure 33B:
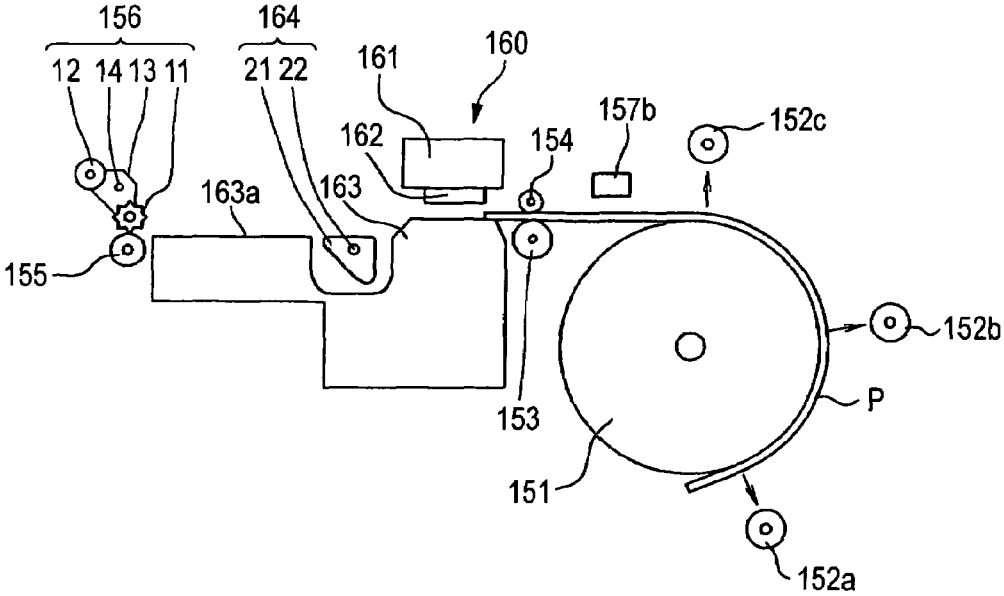

As shown in FIG. 31, the sensor 157*b* is attached to the pivot member 52 that supports the follower roller 154 that is associated with the sheet feeding roller 155. A hole 163*c* is formed in the platen 163 at a position right under the sensor 157*b*. A vertical wall 163*d*, a wall 163*e* that forms an angle of about 135° with the wall 163*d*, and a wall 163*f* that forms an angle of about 90° with the wall 163*d* are formed inside the hole 163*c*.

The sensor 157*b*, which is generally a photoreflector, may operate erroneously due to incidence of external light (sunlight) or reflection of light generated by itself. However, light generated by the sensor 157*b* itself does not return to the sensor 157*b* because it passes through the hole 163*c*, is reflected by the face of the wall 163*e* to change the path by about 90°, and is again reflected by the face of the wall 163*f* to change the path by about 90° (indicated by a dashed line in FIG. 31): an erroneous operation can thus be prevented. External light (sunlight) does not shine on the sensor 157*b* because it is interrupted by the back face of the wall 163*e*: an erroneous operation can thus be prevented.

An operation that is performed when the ink jet printer 100 having the above configuration performs recording on a normal cut sheet will be described with reference to FIGS. 32A and 32B and FIGS. 33A and 33B. First, the control section automatically switches the follower roller unit 156 and the support rib unit 164 for normal cut sheets. More specifically, switching is made to the spur rollers 11 in the follower roller unit 156 and the support ribs 21 of the support rib unit 164 are retracted. The cut sheets P that are stacked and accommodated in the sheet supply tray 210 of the tray unit 200 that is inserted in the sheet supplying/ejecting section 140 are pressed against the sheet supplying roller 142 because the hopper 141 is elevated by the restorative force of the compression spring 144 in synchronism with the rotation of the sheet supplying roller 142 (the synchronization is achieved mechanically). Only the uppermost cut sheet P is separated by the separator 143 and supplied to the transporting section 150.

When the thus-supplied cut sheet P reaches a contact point 151*a* of the sub roller 151 and its follower roller 152*a* (see FIG. 32A), skew correction of the cut sheet P is performed. The method of skew correction depends on the thickness of a recording sheet. In the case of a cut sheet that is as thin as or thinner than an ordinary sheet, first, the leading end portion of the cut sheet P is slightly inserted between the sub roller 151 and its follower roller 152*a*. The rollers 151 and 152*a* are thereafter rotated in the reverse direction to bend the cut sheet P and thereby align the leading end of the cut sheet P to correct the skew.

On the other hand, in the case of a thick cut sheet that is thicker than an ordinary sheet, the leading end of the cut sheet P is knocked against the contact point 151*a* of the sub roller 151 and its follower roller 152*a* and the sheet supplying roller 142 is caused to slip, whereby the leading end of the cut sheet P is aligned to correct the skew. The insertion length or the knock-in length is detected by the sensor 157*a* and the skew correction is controlled on the basis of the detected length.

The reason why the skew correction depends on the recording sheet thickness is that a thin cut sheet is brittle and hence the sheet supplying roller 142 may send out the cut sheet without slipping on it, and that a thick cut sheet is a lamination of thin cut sheets and hence a thin cut sheet may peel off when the rollers 151 and 152*a* are rotated in the reverse direction.

After completion of the skew correction, the cut sheet P is reversed (i.e., the traveling direction is changed to the direction opposite to the sheet supply direction) as it travels along the U-shaped path while being held between the sub roller 151 which is driven by a sheet fed motor (not shown) and its follower rollers 152*a*, 152*b*, and 152*c*. When the leading end of the cut sheet P reaches a detection position DP of the sensor 157*b* (see FIG. 32B), the leading end positioning (i.e., determination of a recording start position) of the cut sheet P is performed.

More specifically, the transport length is detected by the sensor 157*b* until the leading end of the cut sheet P reaches a recording start position HP (see FIG. 33A) after passing the detection position DP and passing between the sheet feeding roller 153 and its follower roller 154. The leading end positioning is controlled on the basis of the detected transport length. Conventionally, the leading end positioning is performed by using the sensor 157*a* that is located upstream of the sub roller 151. In contrast, in this embodiment, since the leading end positioning is performed by using the sensor 157*b* that is located downstream of the sub roller 151, a transport length to be detected is short and, in particular, the accuracy of the leading end positioning can be increased by eliminating a leading end positioning error due to a difference in recording sheet thickness.

The cut sheet P that has been subjected to the leading end positioning is transported to the recording section 160 while being held between the sheet feeding roller 153 which is driven by the sheet feed motor (not shown) and its follower roller 154. The continuation of the holding of the cut sheet P between the sub roller 151 and its follower rollers 152*a*, 152*b*, and 152*c* is a factor of lowering the transport accuracy, and hence the follower rollers 152*a*, 152*b*, and 152*c* are released from the sub roller 151 (see FIG. 33B).

The cut sheet P thus transported is absorbed on the platen 163 by a suction pump (not shown) and is thereby rendered flat, and recording is performed by the recording head 162 mounted on the carriage 161 which is reciprocated for scanning by the carriage motor 166 and the timing belt 165 (not shown). The control section of the ink jet printer 100 performs a high-precision ink dot control, halftone processing, etc. by supplying inks of, for example, a total of seven colors of yellow, light yellow, magenta, light magenta, cyan, light cyan, and black from ink cartridges of the respective colors to the recording head 162 and controlling the discharge timing of the inks of the respective colors and the driving of the carriage 161 and the sheet feeding roller 153. The recorded cut sheet P is ejected to the sheet supplying/ejecting section 140 by transporting it while holding it between the spur rollers 11 and the sheet ejecting roller 155 which is driven by the sheet feed motor (not shown). The cut sheet P is placed (stacked) on the sheet ejection tray 230 of the tray unit 200.

As described above, in the ink jet printer 100 according to this embodiment, the carriage 161 bridges the approximately parallel arranged main guide shaft 61 and auxiliary guide shaft 62 in such a manner that sliding contact is made only in part of the circumference of each of the shafts 61 and 62, whereby the carriage 161 can slide in the axial direction of the shafts 61 and 62. Since the sliding contact between the slide members 70 and 80 of the carriage 161 and the main guide shaft 61 and the auxiliary guide shaft 62 is not made in the entire circumference of each of the shafts 61 and 62, the carriage 151 can be caused to slide smoothly without the need for increasing the accuracy in terms of, for example, the straightness and parallelism of the main guide shaft 61 and the auxiliary guide shaft 62.

The carriage 161 bridges the approximately parallel arranged main guide shaft 61 and auxiliary guide shaft 62 via the main guide plates 63 and the auxiliary guide plates, respectively, whereby the carriage 161 can slide in the axial direction of the shafts 61 and 62. Since the slide members 70 and 80 of the carriage 161 are not in direct contact with the main guide shaft 61 and the auxiliary guide shaft 62, respectively, sliding of the carriage 161 does not cause wear of the main guide shaft 61 and the auxiliary guide shaft 62. Further, the main guide plates 63 and the auxiliary guide plates 64 can be made of a material that is less prone to wear. Employment of this measure can reduce the wear of the main guide plates 63 and the auxiliary guide plates 64, which contributes to keeping the reciprocation of the carriage 161 highly accurate.

Equipped with the springs 84 for urging the auxiliary guide plates 64 toward the auxiliary guide shaft 62, the slide members 80 on the side of the auxiliary guide shaft 61 can press the main guide plates 63 against the main guide shaft 61 via the slide members 70 of the carriage 161 on the side of the main guide shaft 61. Therefore, the carriage 161 can be reciprocated with the main guide shaft 61 as a reference and hence the reciprocation of the carriage 161 can be kept highly accurate.

Since the main guide plates 63 and the auxiliary guide plates 64 are attached to the main guide shaft 61 and the auxiliary guide shaft 62 with prescribed play, the main guide plates 63 and the auxiliary guide plates 64 can bend by an amount corresponding to the play, which makes it possible to absorb attachment errors, working errors, etc. of the main guide plates 63 and the auxiliary guide plates 64 and to thereby keep the reciprocation of the carriage 161 highly accurate.

Since the slide members 70 and 80 are equipped with the radial bearings 71 and 81 that are in contact with the main guide shaft 63 and the auxiliary guide shaft 64, respectively, the resistance of friction on the main guide plates 63 and the auxiliary guide plates 64 can be reduced to a large extent. Therefore, the wear of the main guide plates 63 and the auxiliary guide plates 64 can further be reduced and hence the reciprocation of the carriage 161 can be kept highly accurate.

The gap adjusting mechanism 170 for adjusting the gap between the recording head 162 mounted on the carriage 161 and the platen 163 opposed to the recording head 162 is provided, and the gap is adjusted by synchronously rotating the eccentric main guide shaft 61 and auxiliary guide shaft 62 by the belt mechanism 173 and 174. Therefore, after the horizontality of the plane defined by the main guide shaft 61 and the auxiliary guide shaft 62 and the parallelism of this plane and the guide face 163*a* of the platen 163 have been adjusted, a highly accurate gap adjustment can be performed by rotating the main guide shaft 61 and the auxiliary guide shaft 62 automatically and synchronously by the belt mechanism 173 and 174 while backlash is prevented which tends to occur with a gear mechanism.

Since tension is given to the belt 173 of the belt mechanism 173 and 174 by pushing it from both sides, phase deviation can be prevented while the main guide shaft 61 and the auxiliary guide shaft 62 are rotated synchronously, which enables a highly accurate gap adjustment.

The carriage 161 bridges the approximately parallel arranged main guide shaft 61 and auxiliary guide shaft 62 so as to be slidable in the axial direction of the shafts 61 and 62, and is equipped with the support member 65 that supports the main guide shaft 61 approximately at the center. Therefore, even if the carriage 161 is large, the bend of the main guide shaft 61 can be reduced and hence the reciprocation of the carriage 161 can be kept highly accurate.

The main guide shaft 61 is rotatable about the eccentric rotation axis R. And the support member 65 is equipped with the adjustment member 65*b* that is partially buried in the main guide shaft 61 and has a face whose distance from the rotation axis R is constant in the rotation range and the press member 65*a* for pressing on this face of the adjustment member 65*b*. Therefore, even if the main guide shaft 61 is rotated eccentrically for a gap adjustment, the adjustment member 65*b* and the press member 65*a* can always be kept in contact with each other and hence the support member 65 can always support the main guide shaft 61 approximately at the center.

The support member 65 supports the main guide shaft 61 approximately at the center by pressing on it toward the auxiliary guide shaft 62. Therefore, even if the springs 84 for urging the auxiliary guide shaft 62 are attached to the carriage 161 and the carriage 161 is reciprocated with the main guide shaft 61 as a reference, the main guide shaft 61 can sustain the reaction forces of the springs 84 and hence the reciprocation of the carriage 161 can be kept highly accurate.

The invention can broadly be applied to recording apparatus having a carriage such as a facsimile machine and a copier. The application field of the invention is not limited to a recording apparatus. That is, the invention can be applied to a liquid ejection apparatus in which liquid droplets suitable for an intended use instead of ink droplets are ejected from a liquid ejection head toward a target medium to have those liquid droplets stuck to the subject medium, such as an apparatus having a colorant ejection head to be used for manufacture of color filters of a liquid crystal display device or the like, an electrode material (conductive paste) ejection head to be used for formation of electrodes of an organic EL display, a field-emission display (FED), or the like, a bioorganic material ejection head to be used for manufacture of a biochip, a sample ejection head as precision pipettes, or a like liquid ejection head.

What is claimed is:

1. A carriage mechanism, comprising:

a first shaft member, extending in a first direction;

a second shaft member, extending in the first direction;

a carriage body, disposed between the first shaft member and the second shaft member;

a first plate member fixed on the circumferential part of the first shaft member and extending in the first direction; and a second plate member fixed on the circumferential part of the second shaft member and extending in the first direction;

a first slide member provided in the carriage body and coming in contact with the first plate member; and a second slide member provided in the carriage body and coming in contact with the second slide member, wherein:

the first slide member slides on the first plate member when the carriage body is moved in the first direction, and the second slide member slides on the second plate member when the carriage body is moved in the first direction.

2. The carriage mechanism as set forth in claim 1, further comprising an urging member which urges the second plate member against the second shaft member.

3. The carriage mechanism as set forth in claim 1, wherein:

the first plate member has a C-shaped cross section viewed from the first direction, so that both ends of the C-shaped cross section come in contact with the first shaft member while forming a clearance between the first shaft member and a center part of the C-shaped cross section; and the second plate member has a C-shaped cross section viewed from the first direction, so that both ends of the C-shaped cross section come in contact with the second shaft member while forming a clearance between the second shaft member and a center part of the C-shaped cross section.

4. The carriage mechanism as set forth in claim 1, wherein the first slide member comprises a first rolling member coming in contact with the first plate member, and the second slide member comprises a second rolling member coming in contact with the second plate member.

5. The carriage mechanism as set forth in claim 1, further comprising:

a recording head, carried by the carriage body; and an endless belt member suspended by the first shaft member and the second shaft member, wherein the first shaft member is rotatable about an eccentric axis, and the second shaft member is interlockingly rotated by the endless belt member in accordance with the rotation of the first shaft member, thereby varying a distance between the recording head and a recording target.

6. The carriage mechanism as set forth in claim 5, wherein the endless belt member is tensed.

7. The carriage mechanism as set forth in claim 5, wherein the recording head is a liquid ejection head from which liquid droplets are ejected toward the recording target.

8. A carriage mechanism, comprising:

a carriage body;

a first shaft member, extending in a first direction;

a slider, coming in contact with a first circumferential part of the first shaft member to allow the carriage body to slide on the first shaft member in the first direction; and a support member, which supports the first shaft member, the support member being provided on a second circumferential part of the first shaft member at a longitudinal center portion of the first shaft member, wherein:

the first shaft member is rotatable about an eccentric axis;

the support member comprises:

an adjuster, fitted with the second circumferential part of the first shaft member, and having an outer peripheral face which is configured such that a distance from the eccentric axis is made constant at anywhere in the outer peripheral face;

a retainer, which presses the outer peripheral face of the adjuster against the first shaft member; and the outer peripheral face of the adjustor slides on the retainer in accordance with the rotation of the first shaft member.

9. The carriage mechanism as set forth in claim 8, further comprising a second shaft member extending in the first direction, wherein:

the carriage body is disposed between the first shaft member and the second shaft member; and the second circumferential part is opposite to a circumferential part of the first shaft member which opposes to the second shaft member.

10. The carriage mechanism as set forth in claim 8, wherein the carriage body carries a recording head which performs recording operation with respect to a recording medium being transported in a second direction perpendicular to the first direction.

11. The carriage mechanism as set forth in claim 10, wherein the recording head is a liquid ejection head from which liquid droplets are ejected toward the recording medium to perform the recording operation.

* * * * *